US009775430B2

(12) United States Patent
Abu-Akel et al.

(10) Patent No.: US 9,775,430 B2
(45) Date of Patent: Oct. 3, 2017

(54) MOBILE COMPUTER WORKSTATION

(71) Applicant: TOUCHPOINT MEDICAL, INC., Concordville, PA (US)

(72) Inventors: Fouad Geries Abu-Akel, Duluth, GA (US); S. N. K. Gupta Anumalasetty, Pune (IN); Christopher M. Radvanyi, Shavertown, PA (US); Carey Roberts, Wilkes-Barre, PA (US); Robert R. Steele, Sweet Valley, PA (US); Karl Haiden, Lawrenceville, GA (US); John Zelena, Kingston, PA (US); Johnson Lin, Taipei (TW); Nick Blackburn, Wellesley (CA); Robert Sobie, Shavertown, PA (US)

(73) Assignee: TOUCHPOINT MEDICAL, INC., Concordville, PA (US)

( * ) Notice: Subject to any disclaimer, the term of this patent is extended or adjusted under 35 U.S.C. 154(b) by 20 days.

(21) Appl. No.: 14/772,008

(22) PCT Filed: Feb. 23, 2014

(86) PCT No.: PCT/US2014/017870

§ 371 (c)(1),
(2) Date: Sep. 1, 2015

(87) PCT Pub. No.: WO2014/133915

PCT Pub. Date: Sep. 4, 2014

(65) Prior Publication Data

US 2016/0015167 A1 Jan. 21, 2016

Related U.S. Application Data

(60) Provisional application No. 61/771,512, filed on Mar. 1, 2013.

(30) Foreign Application Priority Data

Apr. 25, 2013 (IN) ..... 1519/MUM/2013

(51) Int. Cl.
*A47B 21/02* (2006.01)
*A47B 21/04* (2006.01)
(Continued)

(52) U.S. Cl.
CPC ..... *A47B 21/02* (2013.01); *A47B 21/03* (2013.01); *A47B 21/0314* (2013.01);
(Continued)

(58) Field of Classification Search
CPC .. B62B 3/02; B62B 3/022; B62B 3/04; A47B 21/04
See application file for complete search history.

(56) References Cited

U.S. PATENT DOCUMENTS 5,687,939 A 11/1997 Moscovitch
6,231,016 B1 5/2001 Slone
(Continued)

FOREIGN PATENT DOCUMENTS

WO 2008024722 A2 2/2008

OTHER PUBLICATIONS

International Search Report and Written Opinion for PCT/US2014/017870, dated Aug. 11, 2014; ISA/US.
International Preliminary Report on Patentability for PCT/US2014/017870 with Annex, dated Mar. 6, 2015; ISA/US.
Extended European Search Report issued in EP 24 756 972.7 dated Sep. 8, 2016 (5 pages).
(Continued)

*Primary Examiner* — Erez Gurari
(74) *Attorney, Agent, or Firm* — RatnerPrestia

(57) ABSTRACT

A mobile computer workstation is disclosed and generally includes a base assembly, a power supply, a column assem-
(Continued)

bly, a tray assembly, a monitor support assembly and a tray controller. The power supply can be housed in the base assembly. The column assembly is linearly extensible and extends upward from the base assembly. The column assembly can carry the tray assembly and monitor support assembly. The workstation can be optionally configured with a variety of storage solutions for any of a number of work environments and tasks. The tray assembly can house a computer that is integrated into the workstation. The tray controller provides a measure of security for the workstation by allowing access to the workstation and control over its features only by authorized users.

32 Claims, 29 Drawing Sheets

(51) Int. Cl.
*A47B 21/06* (2006.01)
*A47B 21/03* (2006.01)

(52) U.S. Cl.
CPC ..... *A47B 21/04* (2013.01); *A47B 21/06* (2013.01); *A47B 2021/035* (2013.01); *A47B 2021/0364* (2013.01); *A47B 2021/0392* (2013.01)

(56) References Cited

U.S. PATENT DOCUMENTS

| | | | | |
|---|---|---|---|---|
| 6,285,150 | B1 | 9/2001 | Adam et al. | |
| 6,554,235 | B1 | 4/2003 | Fortier | |
| 6,669,552 | B1 | 12/2003 | Beer | |
| 2007/0001413 | A1 | 1/2007 | Rossini | |
| 2007/0227409 | A1* | 10/2007 | Chu | A47B 21/00 108/50.02 |
| 2007/0228680 | A1* | 10/2007 | Reppert | A47B 21/00 280/47.35 |
| 2008/0002344 | A1 | 1/2008 | Gaskill | |
| 2009/0084910 | A1 | 4/2009 | White | |
| 2010/0127189 | A1 | 5/2010 | Boyarsky et al. | |
| 2011/0050541 | A1 | 3/2011 | Shin et al. | |

OTHER PUBLICATIONS

Supplementary European Search Report issued in EP 14 75 6972 dated Sep. 27, 2016 (3 pages).

Substantial Examination Report issued in Saudi Arabia Patent application No. 515360962 dated Dec. 16, 2016, 20 pages (with English translation).

* cited by examiner

MOBILE COMPUTER WORKSTATION

CROSS-REFERENCE TO RELATED APPLICATIONS

This application is a U.S. National Phase Application under 35 U.S.C. 371 of International Application No. PCT/US2014/017870 filed on Feb. 23, 2014 and published as WO 2014/133915 A1 on Sep. 4, 2014. This application claims the benefit of U.S. Provisional Application No. 61/771,512, filed on Mar. 1, 2013. This application also claims the benefit and priority of Indian Provisional Application No. 1519MUM2013, filed Apr. 25, 2013. The entire disclosures of the above applications are hereby incorporated herein by reference.

FIELD

The present disclosure relates to a mobile computer workstation and, more particularly, to a point-of-care mobile computer workstation.

BACKGROUND

The statements in this section merely provide background information related to the present disclosure and cannot constitute prior art.

Mobile computer workstations providing mobile work platforms and storage capabilities are known in the art. Generally, in such mobile workstations, an adjustable height work surface and a storage space can be integrated with a computer, display and related components and peripherals on a wheeled chassis. While the above mobile computer workstations have proven satisfactory for their purposes, further improvements in such devices would be beneficial.

SUMMARY

In accordance with the teachings of the present disclosure, a point of application mobile computer workstation is disclosed. The workstation generally includes a base assembly, a power supply, a column assembly, a tray assembly, a tray controller, a keyboard tray assembly, a monitor support assembly, a computer and computer monitor, and an optional storage module.

The workstation includes a base assembly that provides a foundation for the workstation. The base assembly houses the power supply for the workstation. The base assembly includes wheeled chassis that enables the workstation to roll and easily be moved. Releasable wheel locks can also be included to enable the user to selectively prevent the wheels from rotating. In such a configuration, a workstation is provided that can easily be alternated between states of free and restricted mobility.

The workstation includes a power supply for providing electrical power to the workstation and its accessories and/or peripheral components. The power supply is housed in the base assembly. The power supply can comprise a power adapter and charger and one or more rechargeable batteries. The power supply receives AC power from, for example, a wall outlet, and delivers DC power to the workstation and its components. In another example, the power supply receives AC power and relieves AC power directly to the components. In another example, the power supply receives AC power from a wall outlet and converts the AC power into DC power. The power supply supplies DC power to the components of the workstation. In yet another example, the power supply receives AC power from a wall outlet. The power converts the power to DC and/or directly supplies AC power to the components of the workstation. The power supply receives AC power from the wall outlet and supplies the AC power to a battery charger. The battery charger charges a plurality of batteries. The workstation can operate on power from the batteries or, alternatively, from the power adapter and charger. The power supply has two operating modes—FAN-on and FAN-off (i.e., fan-less) mode.

The workstation includes a column assembly that can extend vertically from the base assembly. The tray assembly, monitor support assembly, and optional storage module can, in turn, be mounted to the column assembly. The column assembly can be vertically adjustable to control the position of tray assembly and monitor support assembly to suit a wide range of user preferences under a variety of working conditions, such as standing or being seated, for example. An adjustable column assembly can comprise a linearly extensible vertical support structure and a column length adjustment device. For example, the column assembly can comprise an upper and a lower column that are telescopically nested with one another and are configured for relative movement therebetween. The column length adjustment device or lift mechanism can control the vertical displacement and relative positioning of the upper and lower columns, as desired by the user. Such adjustment can be accomplished by the user under power supplied by the workstation. The column length adjustment device can include a motorized, hydraulically, or pneumatically driven device. The device can incorporate a gear mechanism, a ball screw mechanism, a spring, a piston, a cable, a spool, a pulley and similar types of structures or components. Because the column assembly can telescope, the workstation is capable of collapsing to a height to facilitate easy transport. Likewise, the workstation is capable of vertically extending to facilitate the preferences and working styles of various users, such as users who can be standing or seated at the workstation.

Wiring for the workstation, such as power cords and communication cables, for example, can be routed through the an interior space of the column assembly from the base assembly to the tray assembly, monitor support assembly or storage module. This feature enables the workstation to have a cleaner, more efficient appearance, helps avoid the inadvertent disconnection of cords or cables by the user and protects the cords and cables from excessive wear.

Moreover, an interior space of the column assembly can serve as a ventilation path or chimney enabling heat and/or hot air to escape from the power supply that is housed in the base assembly.

The tray assembly is mounted to the column assembly above the base assembly. The tray assembly provides the workstation with an ample work space and a securable storage space for technology devices and related peripherals or components. The top of the tray assembly includes a generally flat, horizontal work surface that provides a space where the user can perform the general work duties that are associated with the use of the workstation. An interior of the tray assembly can include a technology compartment which can be configured to arrange and store a computer, such as a laptop, a notebook, a low power, ultra small form factor computer, or thin client computer, for example, and related wiring, hardware and/or electronics, spare parts, and/or peripheral components that can be integrated into or included with the workstation. The technology compartment can be lockable or securable to control the physical access to the interior except for authorized personnel. When the technology compartment is accessible, the work surface can be lifted or removed to provide access to the technology compartment. The size and space provided by the technology compartment can be adjustable by an integrated expansion wall included in one or more of the side walls of the tray assembly. The technology compartment can provide ventilation for cooling.

In addition, an optional storage module can be included in the workstation. The storage module can be attached to the column assembly. The storage module can be configured in any of a variety of storage solutions to enable the workstation to be suitable for any of a number of work environments and tasks. The storage module can incorporate any of a variety of storage solutions into the workstation, including any combination of drawers, trays, shelves, and storage cassettes, among others.

As one example, a removable storage cassette assembly which houses multiple slide-out drawers or cassette bins that are suited for the storage and organization of any of a variety of items can be integrated into the workstation. Such a configuration can be suitable for use in a workstation adapted for medical point-of-care (POC) service. In this regard, the workstation can be configured for the storage and dispensing of pharmaceuticals and/or medical items, like medications, syringes, bandages, gauze, tape, and the like. The cassette assembly and/or cassette bins can be easily removed from the workstation to be re-supplied. As such, the entire workstation does not have to be out of use during such periods.

A keyboard tray assembly can be mounted to the tray assembly, upon which a computer keyboard can be located. The keyboard tray assembly can be located at a use position and a stowed position. In a use position, the keyboard tray assembly is extended forward of the tray assembly so the computer keyboard can be accessible and ergonomically situated for a user. In a stowed position, the keyboard tray assembly can be stored generally beneath the tray assembly.

Additionally, the keyboard tray assembly can include an auxiliary work surface. The auxiliary work surface can comprise a tray or shelf that can be extended from either the left or right side of the keyboard tray assembly. The auxiliary work surface provides the user with additional flat work space, and can accommodate workstation peripherals, such as a computer mouse, for example. Because it can be alternatively located on either the right or left of the keyboard tray assembly, the auxiliary work surface provides additional flexibility for a user to personally configure the workstation.

A monitor support assembly can mount to the upper end of the column assembly. Like the column assembly, the monitor support assembly enables the hidden and protected routing of wiring for the workstation like power cords and communication cables. A computer monitor can be attached to the monitor support assembly with bracketing that permits positioning, tilting and/or rotating of the computer monitor relative to the work surface.

Alternatively, a dual computer monitor configuration can be incorporated. In this alternative arrangement, the computer monitor can be incorporated into the workstation with bracketing that can permit individual and/or simultaneous rotation of the two computer monitors such that they can fold inward upon themselves. With the two computer monitors folded in this manner, the workstation can be easier to maneuver in small spaces and visibility can be improved while transporting the workstation.

The tray controller can be disposed within the tray assembly. The tray controller provides a measure of security for the workstation by allowing access to the workstation only by authorized users. In this regard, the tray controller enables an authorized user to gain physical access to the workstation's storage module, if so equipped, and the items stored therein, such as by enabling the user's control over a variety of locking features that can be integrated into the workstation. Alternatively, the tray controller can also provide authorized users with electronic access to an onboard computer, the computer keyboard, login authentication to the computer and/or a computer network and access to the computer's peripherals, if any. The tray controller also includes a variety of indicators for the workstation's user, such as LEDs that indicate the status of the power supply or its components. For instance, the LEDs can indicate the level of charge held by the power supply or the condition of its batteries. The tray controller can also enable the user to manage any user-adjustable features or settings of the workstation.

In still another aspect of the workstation of the disclosure, the workstation incorporates a sanitizing device for disinfecting the workstation and/or its components or peripherals. For example, an ultra-violet germicidal light emitting UV-C light can be included in the tray assembly such that it can emit a germ-killing ultra-violet light directed at the keyboard tray assembly and the keyboard when they are in the stored position to sanitize those components. As another example, a UV-C light wand can be included with the workstation as a peripheral device to enable a user to "sweep" the workstation and its components, such as the work surface, monitor, keyboard, mouse, and other peripheral components with the germ-killing ultra-violet light to sanitize the workstation.

Further areas of applicability will become apparent from the description provided herein. It should be understood that the description and specific examples are intended for purposes of illustration only and are not intended to limit the scope of the present disclosure.

DRAWINGS

The several drawings included herewith are for illustration purposes only and are not intended to limit the scope of the present disclosure in any way.

Figure 17C:
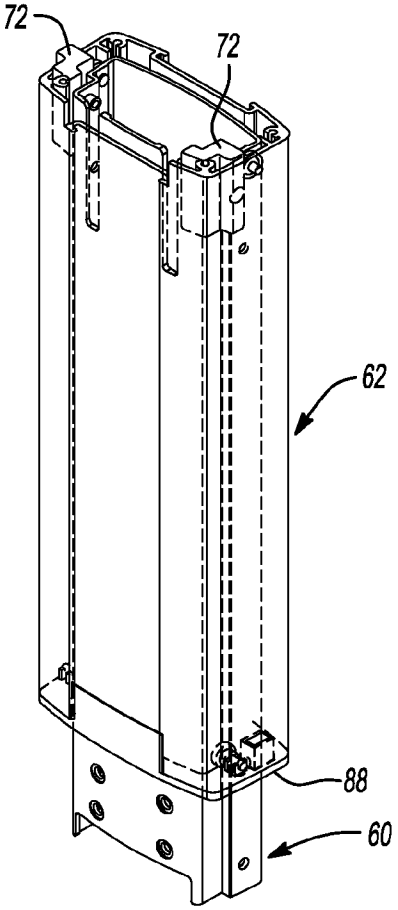
Figure 17B:
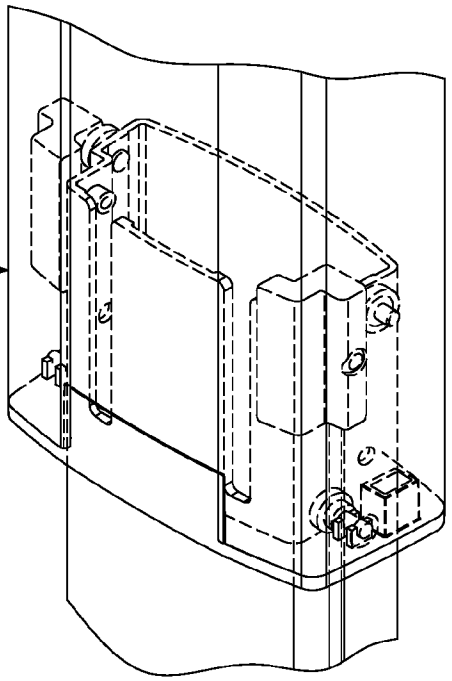
Figure 17A:
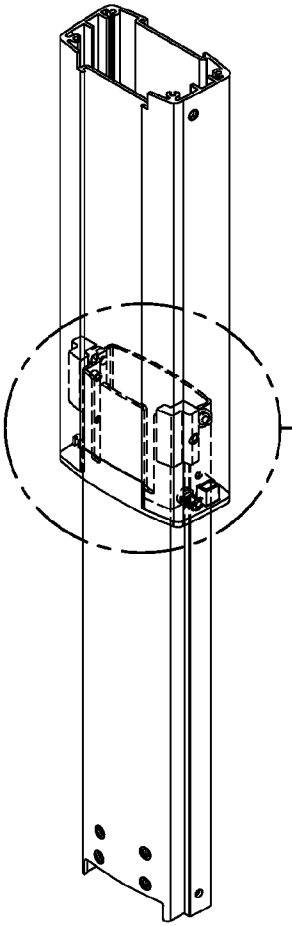
Figure 18A:
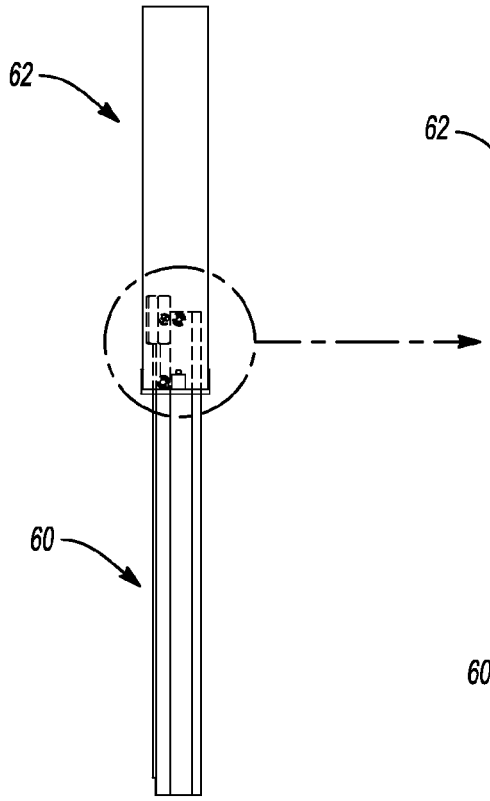
Figure 18B:
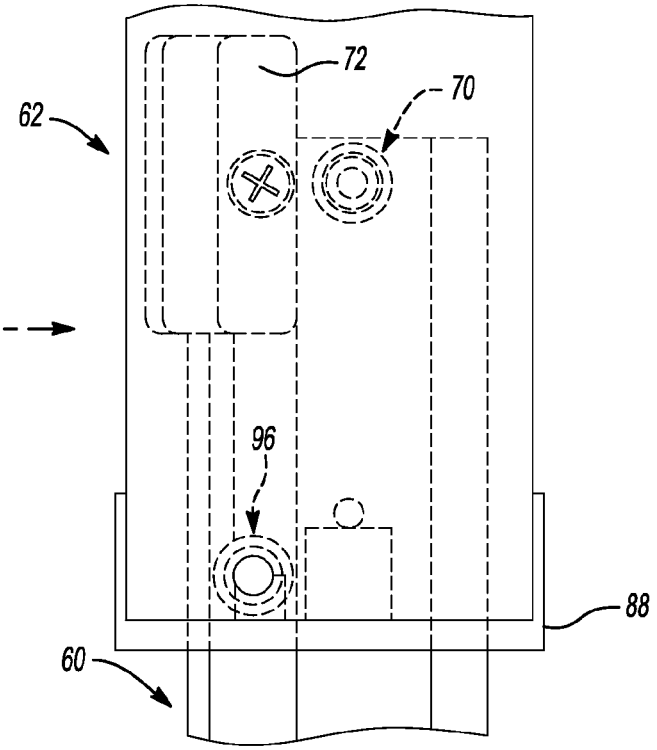
Figure 19:
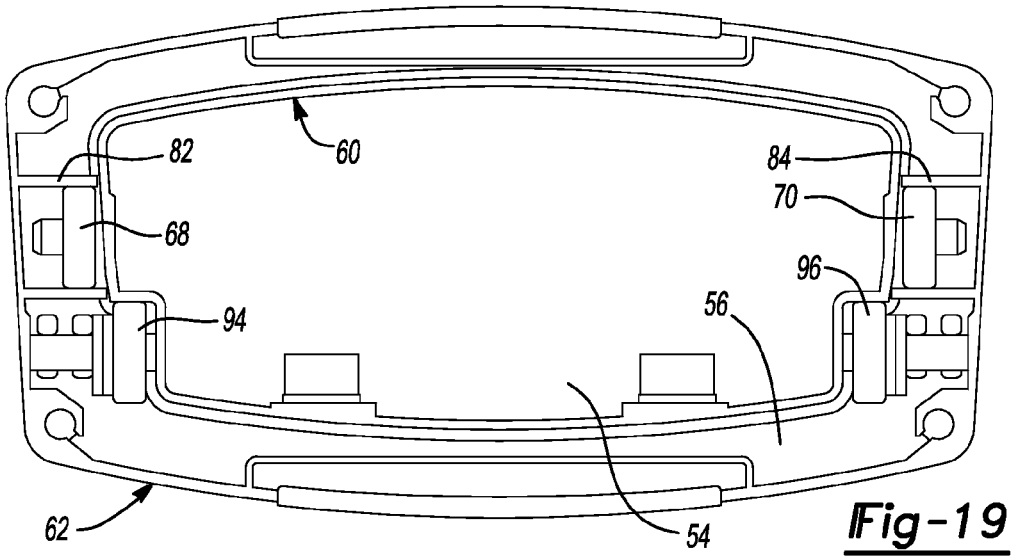
Figure 20:
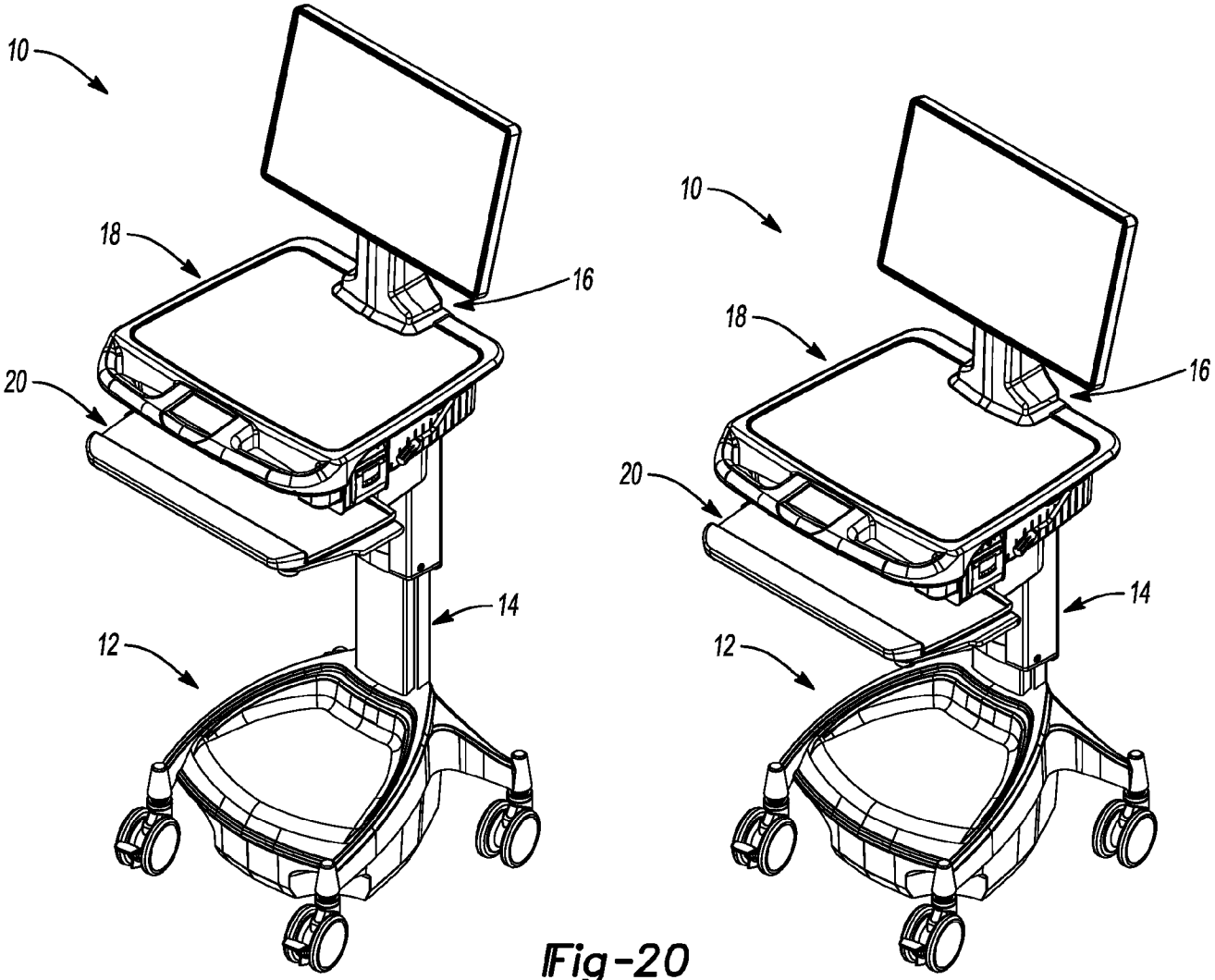
Figure 21:
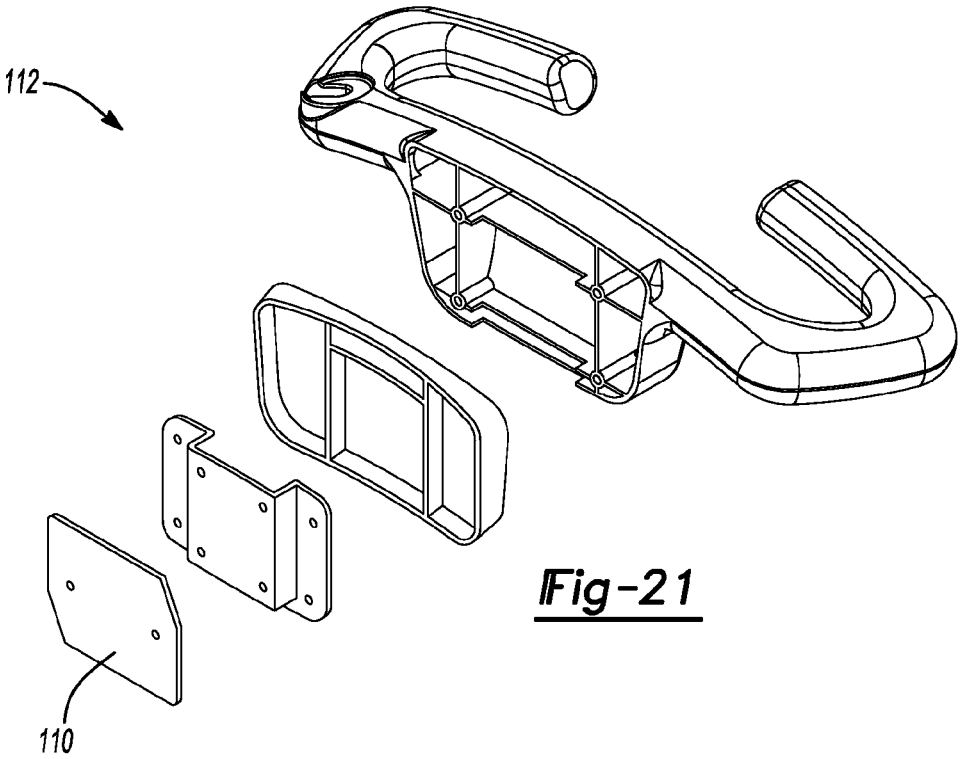
Figure 22:
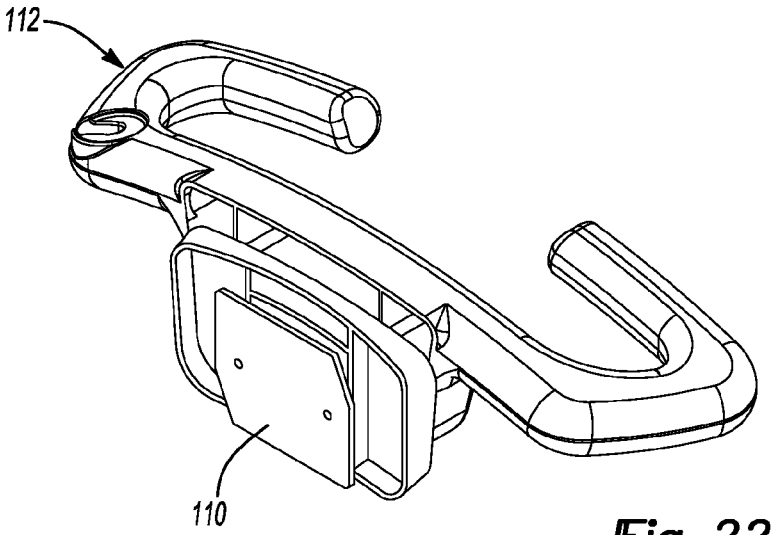
Figure 23:
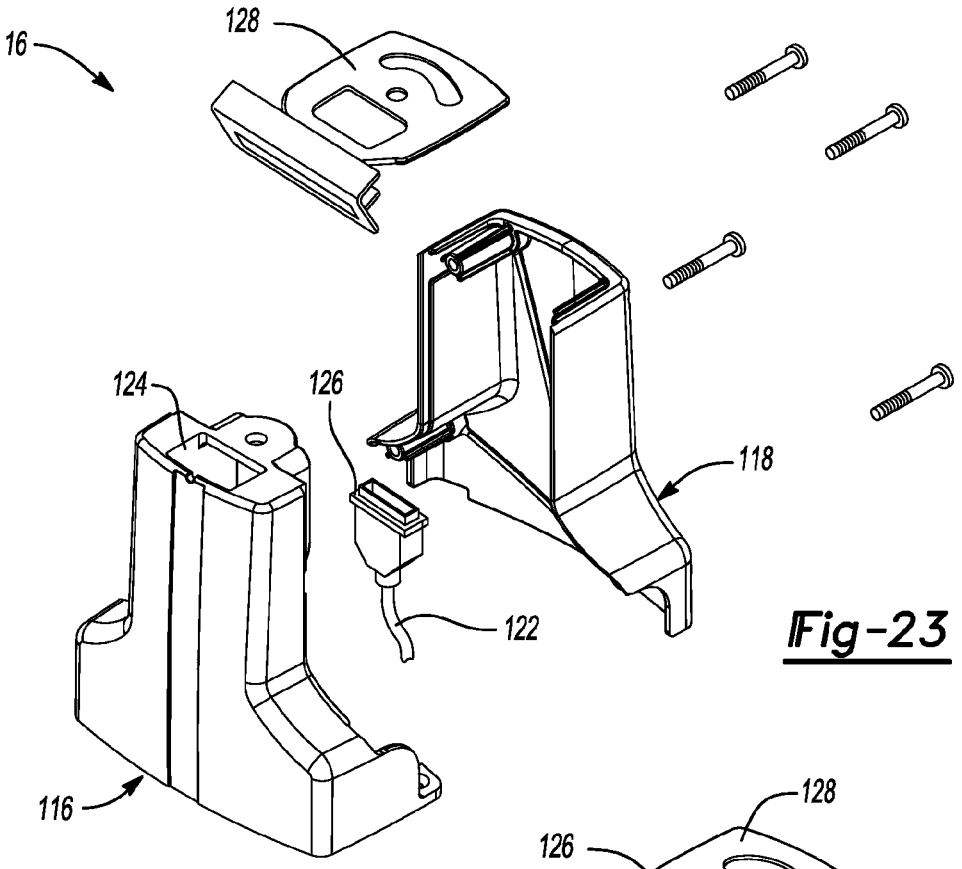
Figure 24:
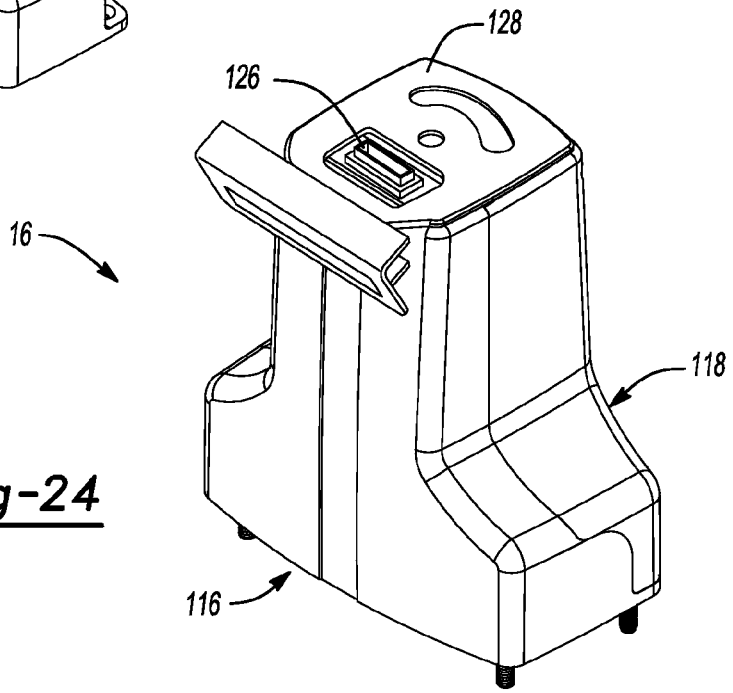
Figure 25:
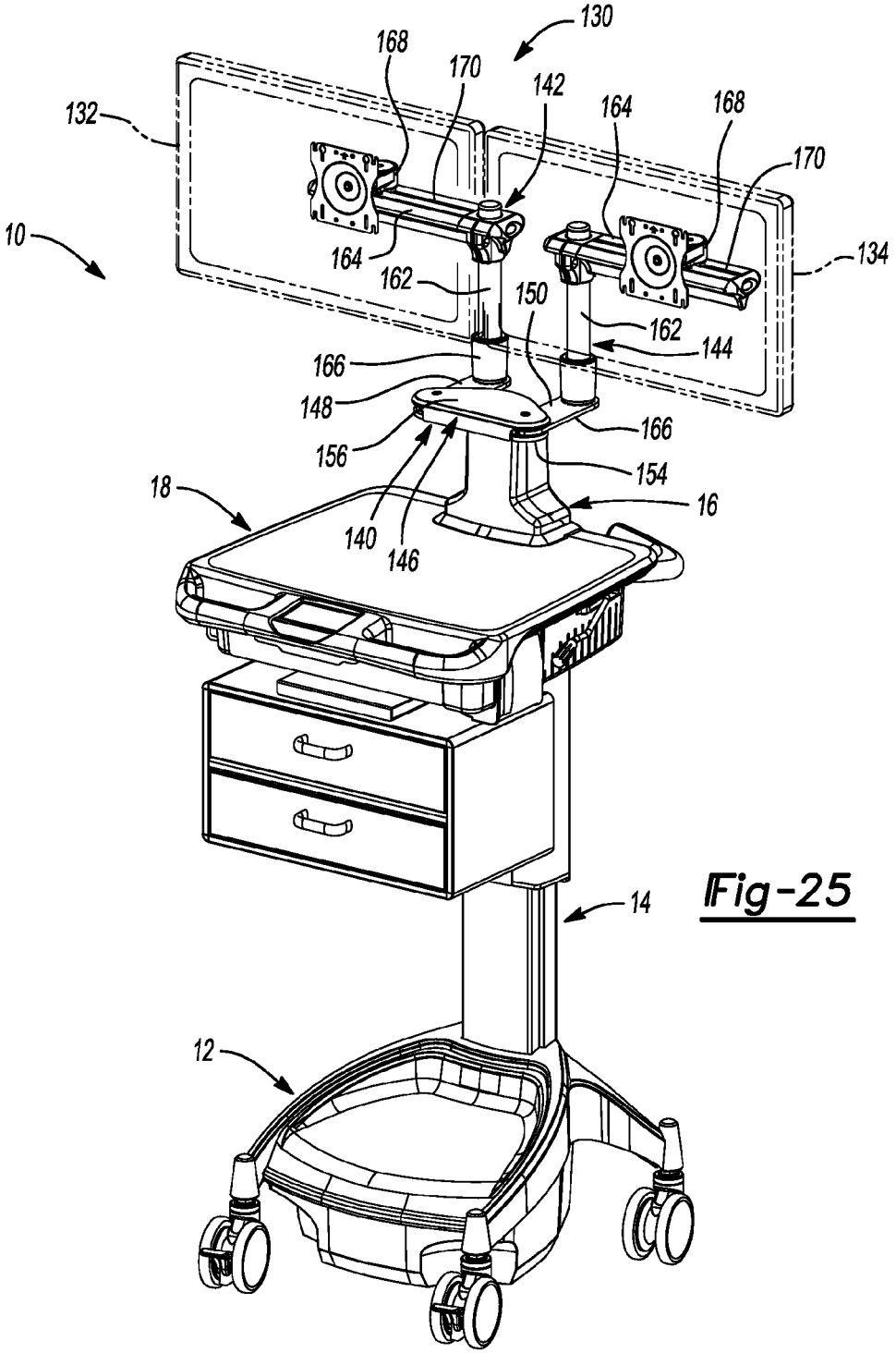
Figure 26:
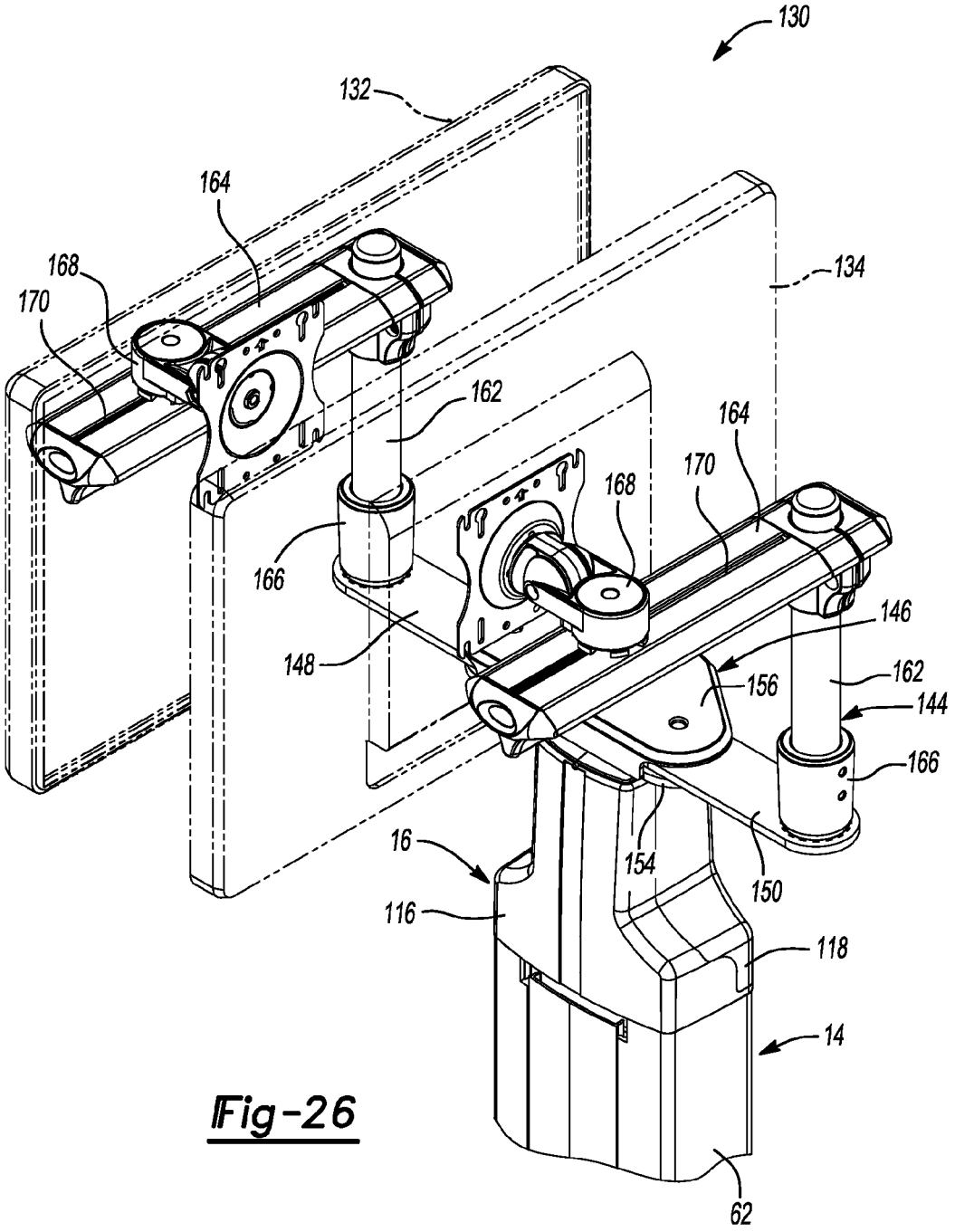
Figure 27:
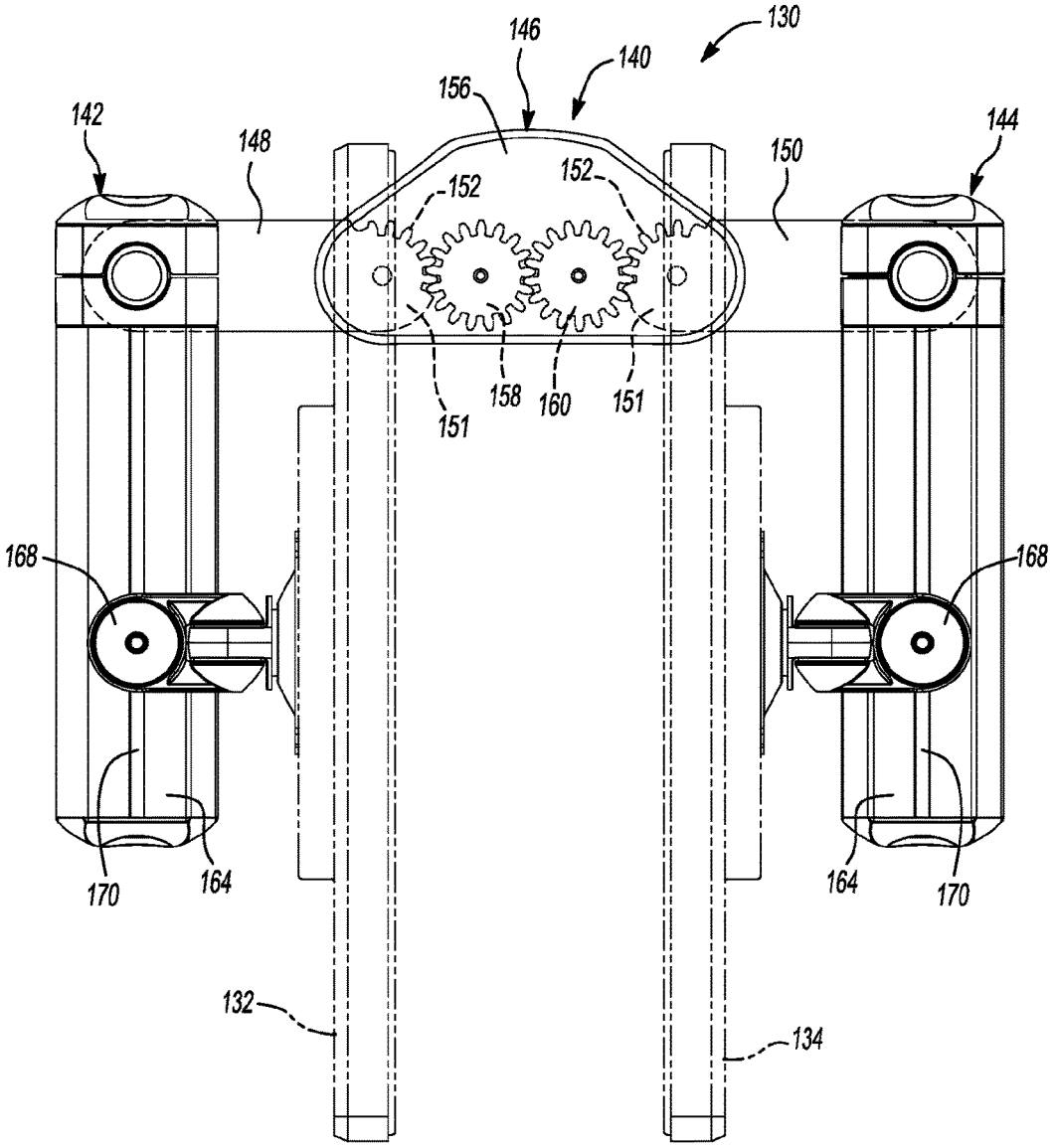
Figure 28:
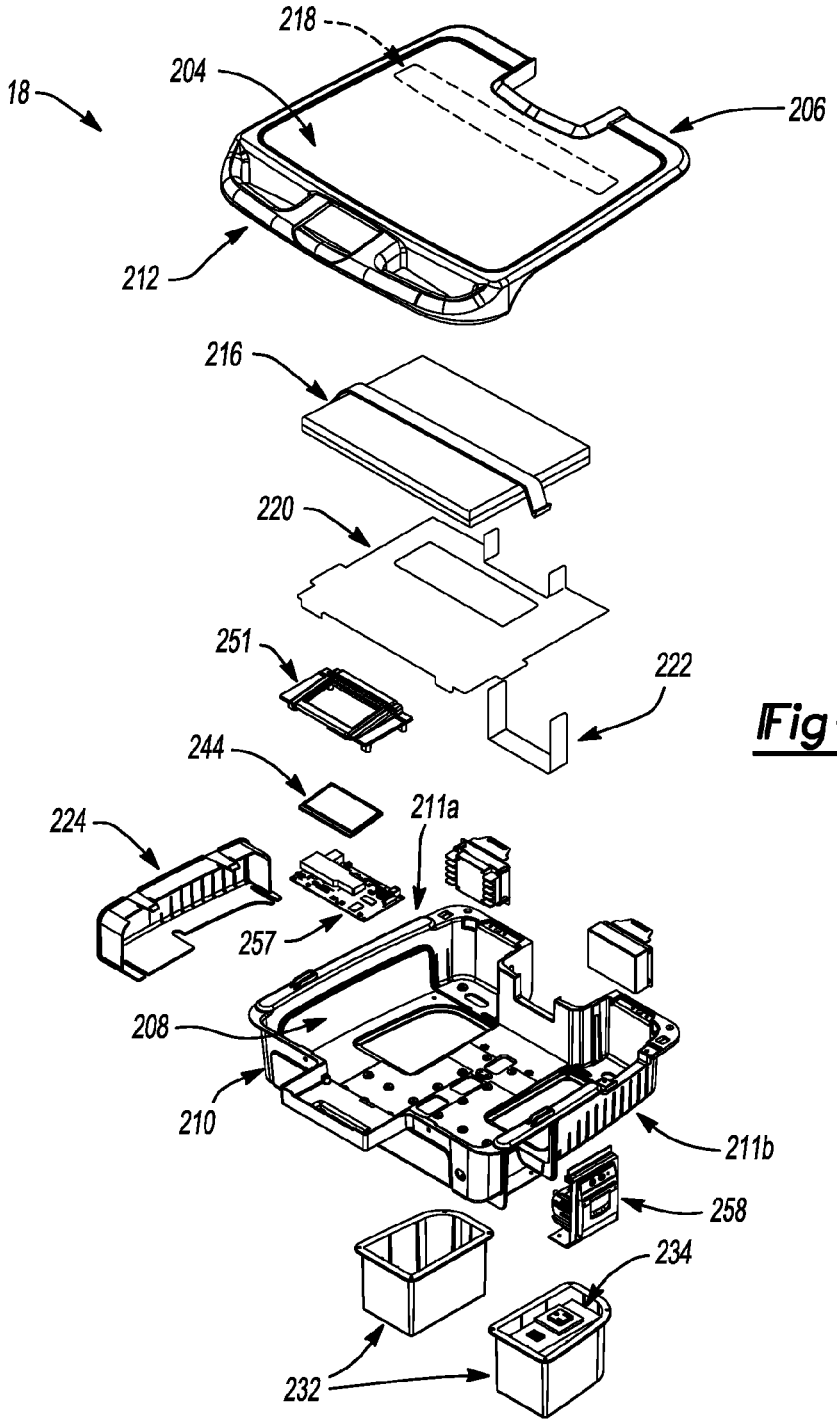
Figure 29:
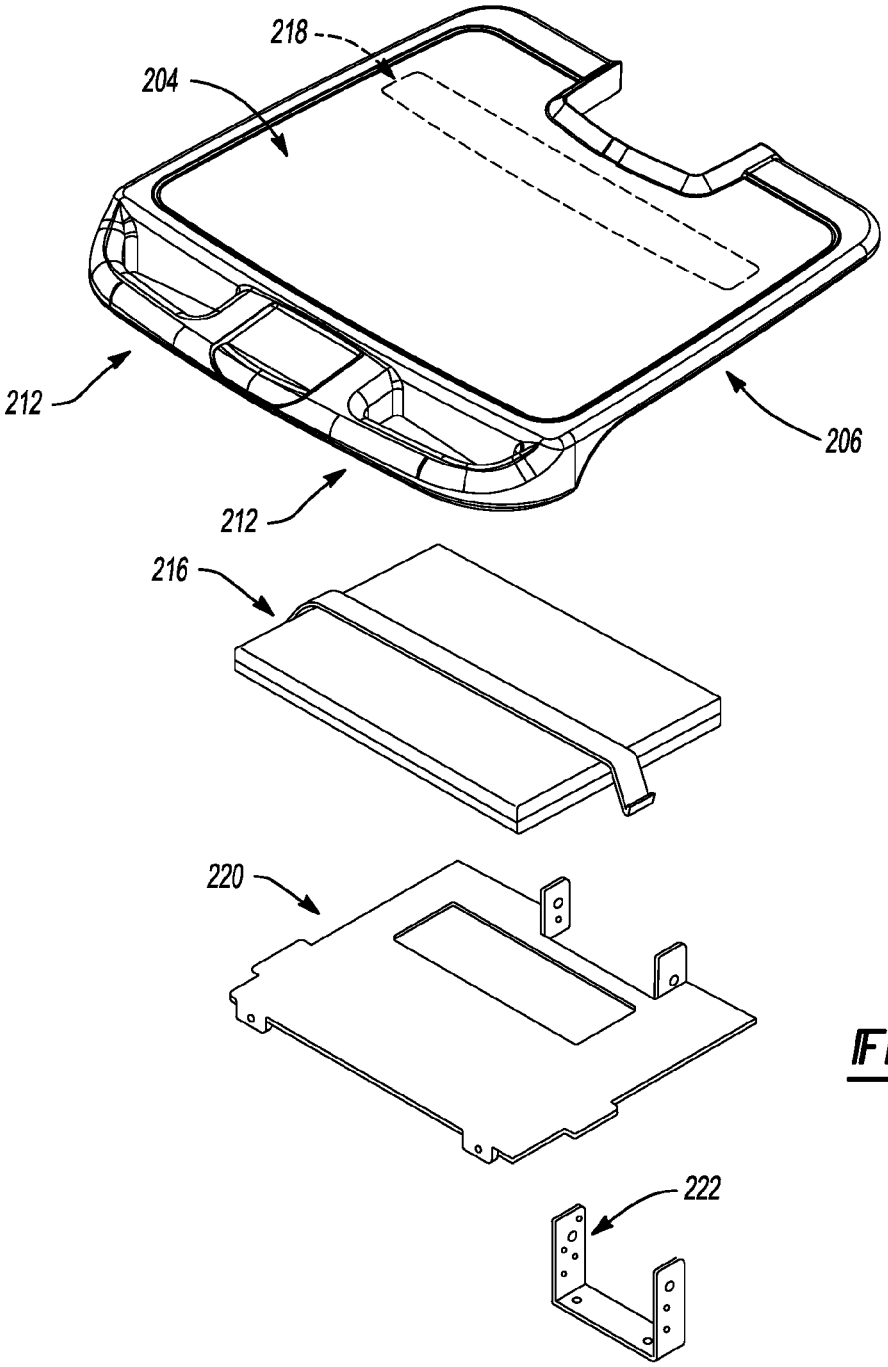
Figure 30:
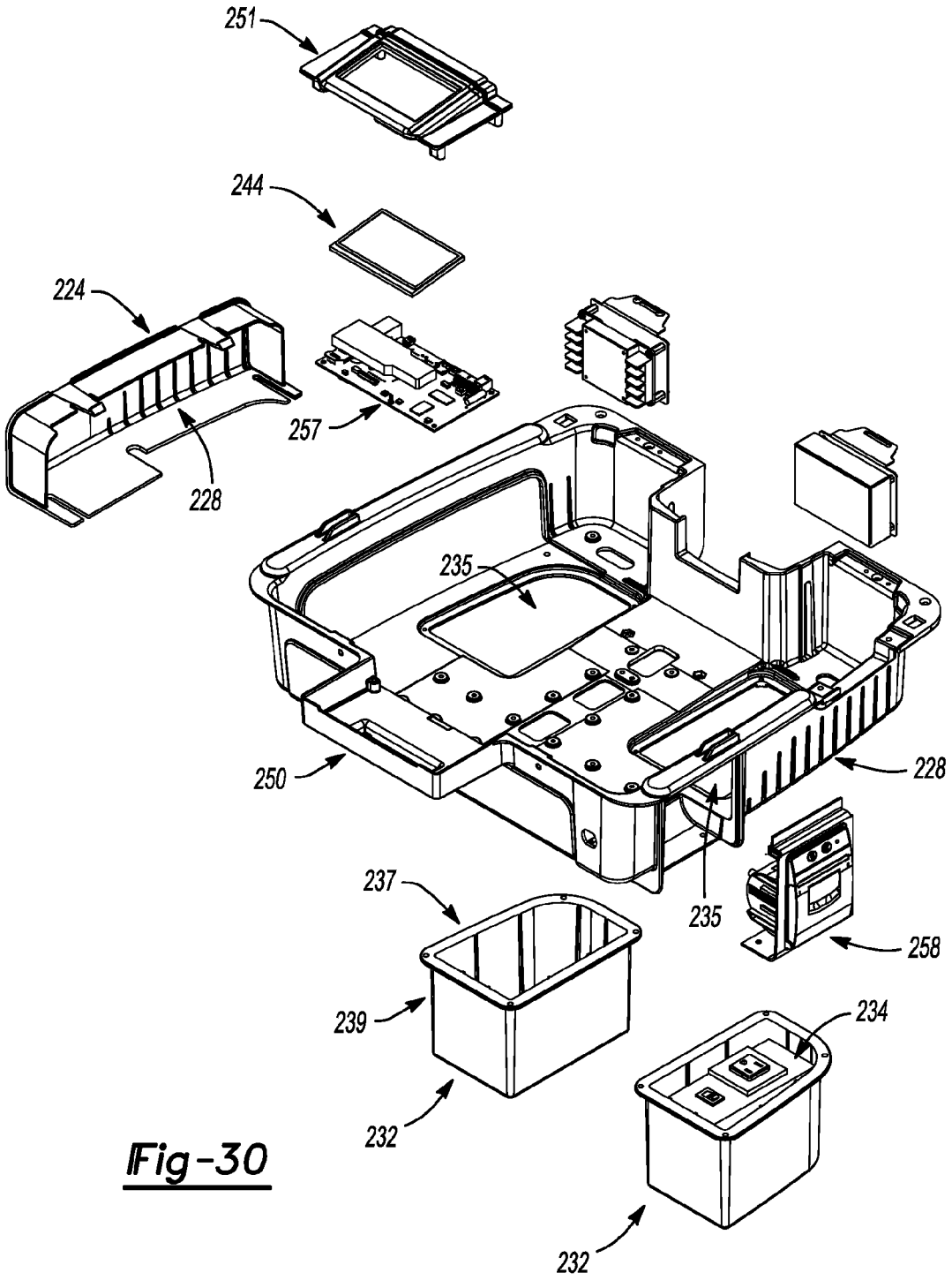
Figure 31A:
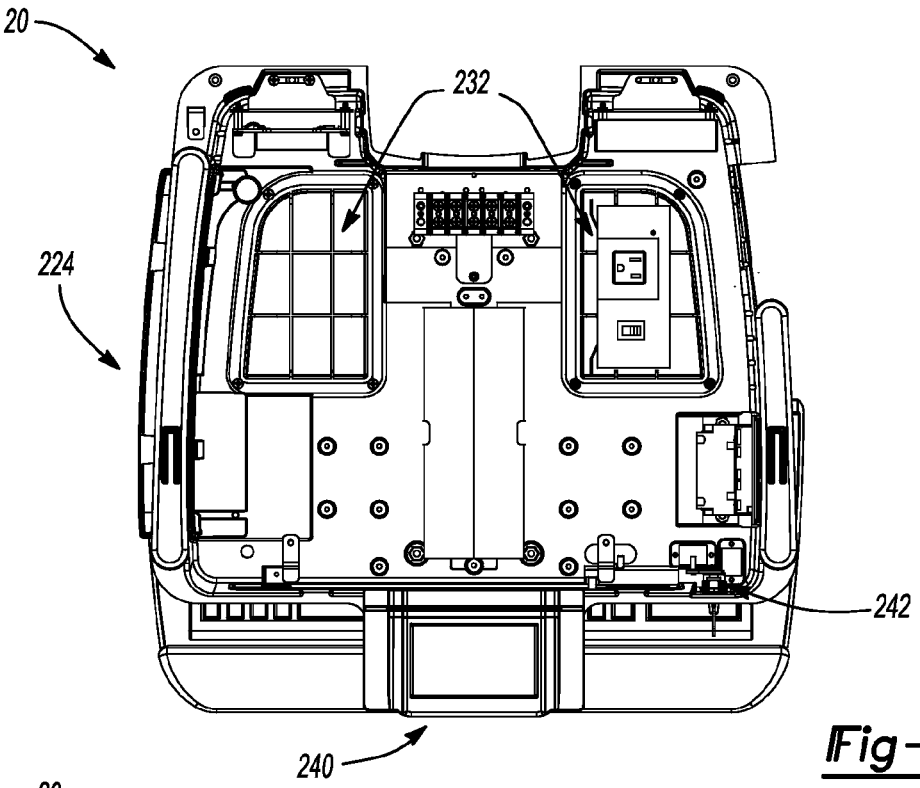
Figure 31B:
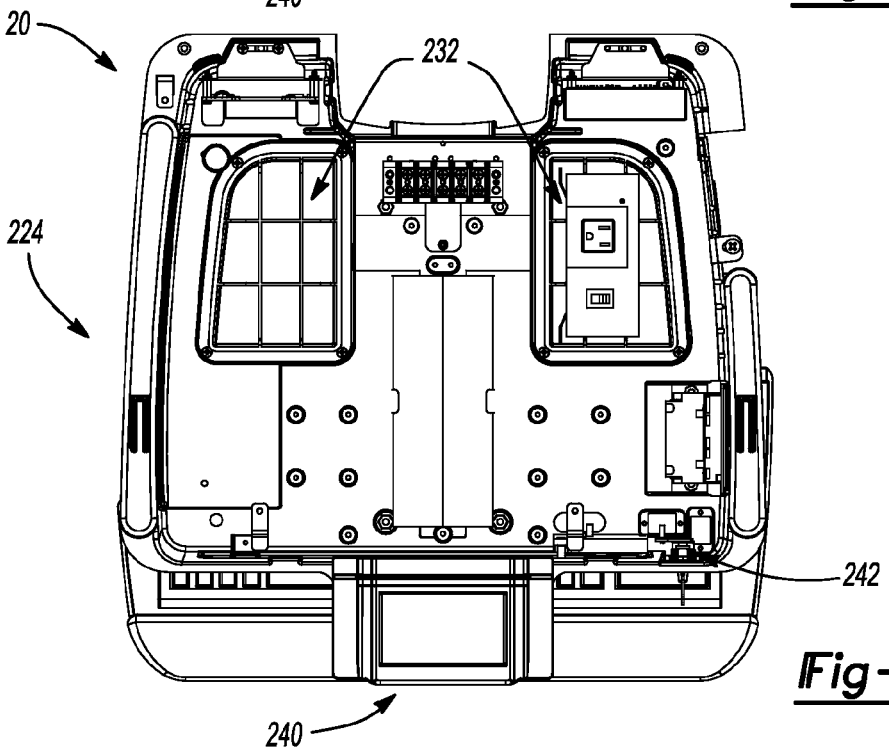
Figure 32:
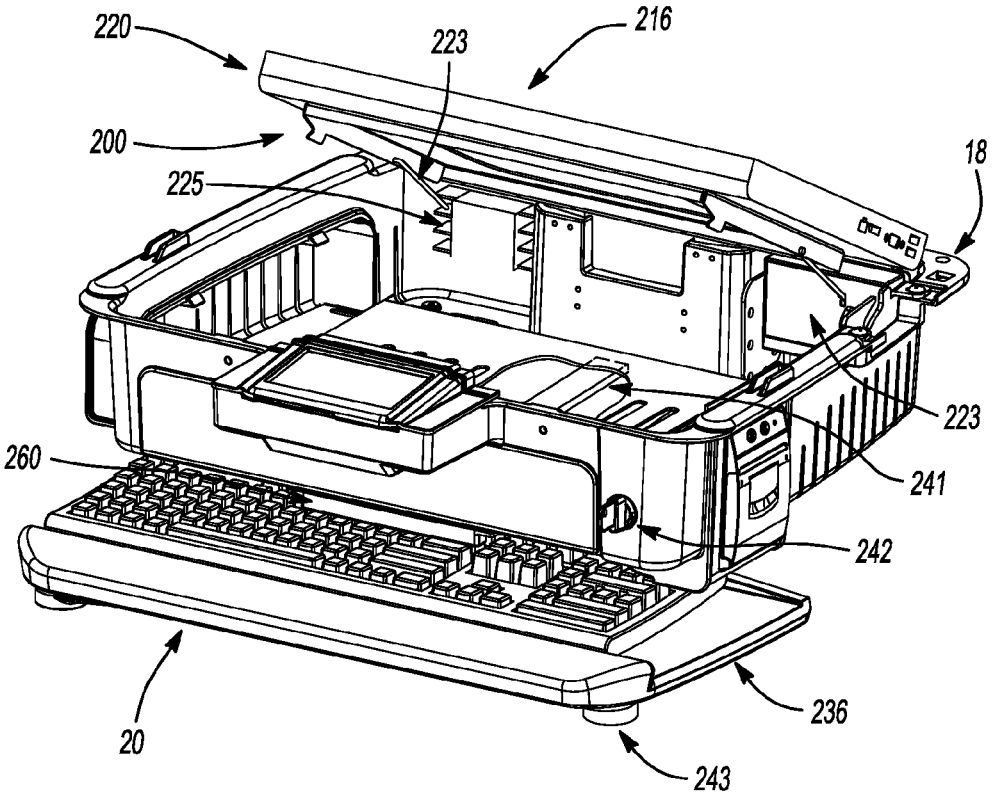
Figure 33:
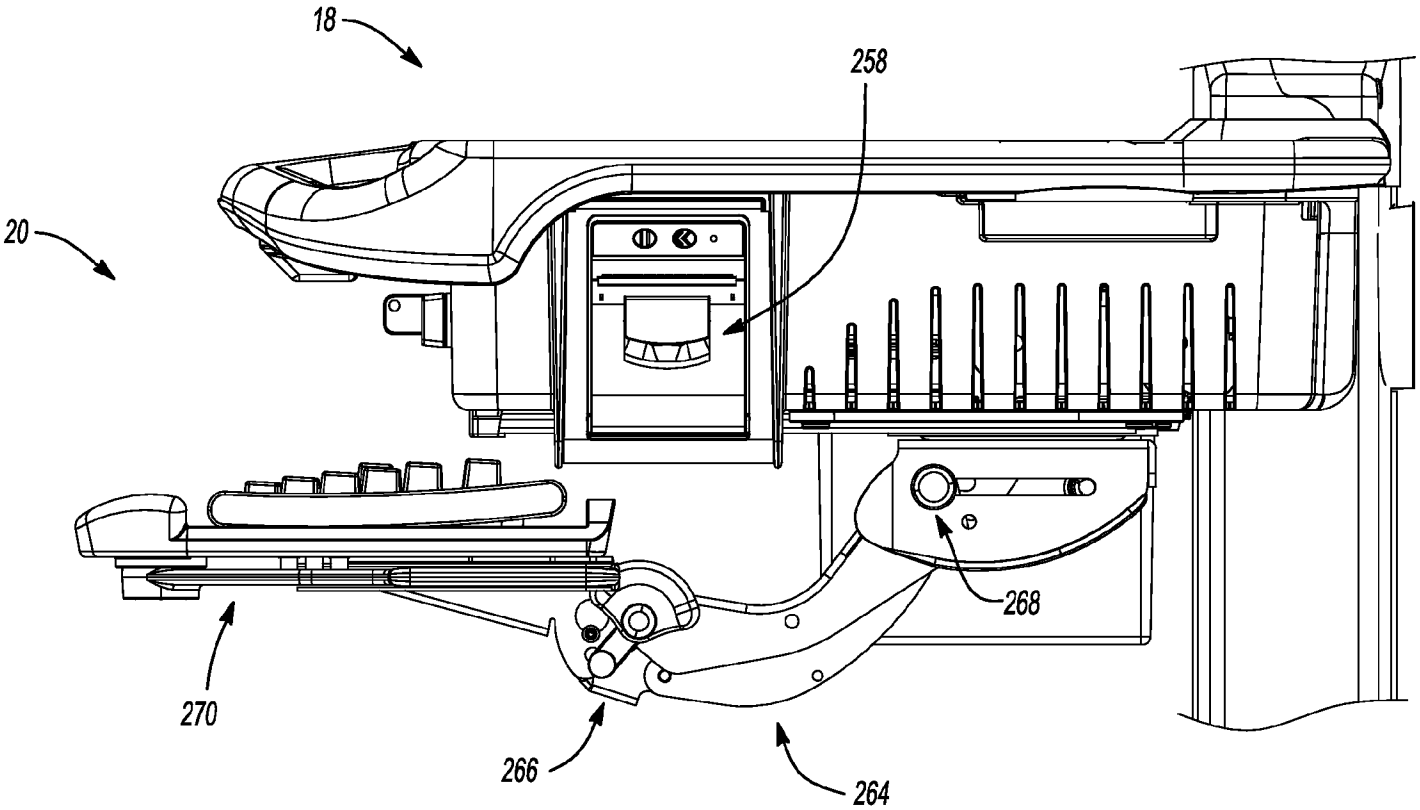
Figure 34:
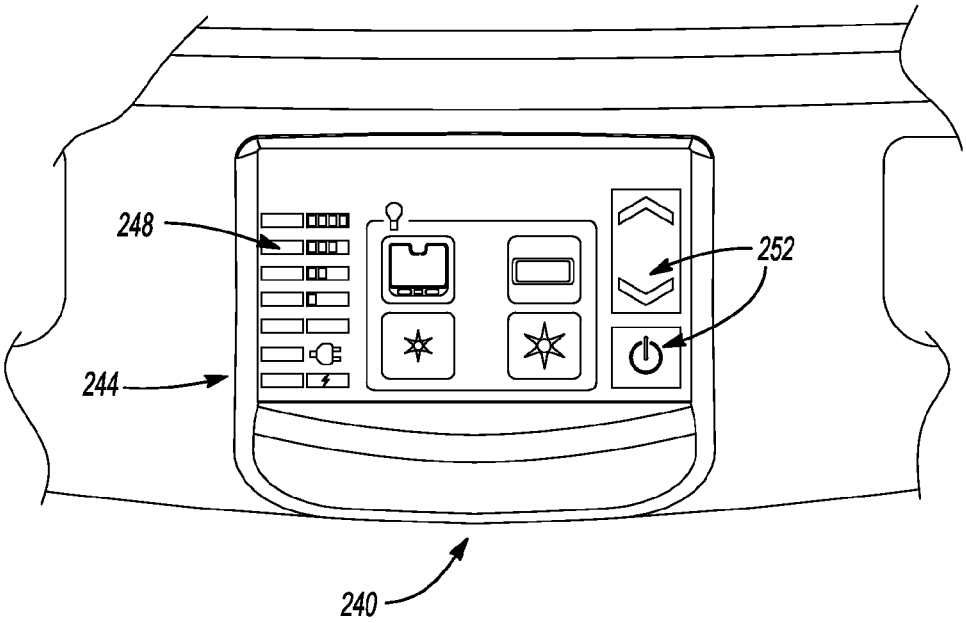
Figure 35:
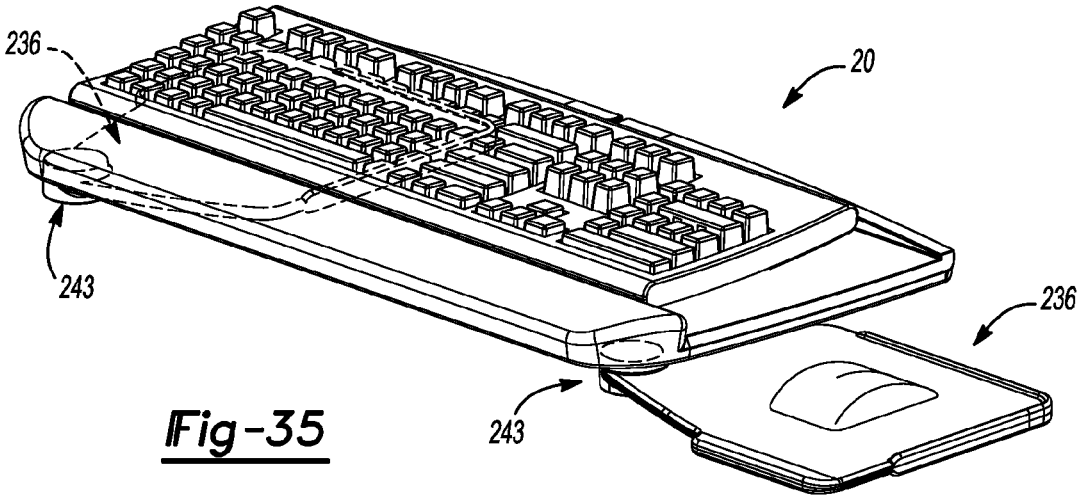

FIGS. 17*a*-17*c* are perspective views of the adjustable column assembly and the bearings of the adjustable column assembly;

FIG. 18*a* is a side view of the adjustable column assembly and the bearings of the adjustable column assembly;

FIG. 18*b* is an enlarged detail portion of FIG. 18*a* showing the adjustable column assembly;

FIG. 19 is a cross-sectional view of the of the adjustable column assembly and roller bearings of the adjustable column assembly with linear bearings of the adjustable column assembly removed;

FIG. 20 is a perspective view of two of the mobile computer workstations in two different vertical positions according to the principles of the present disclosure;

FIG. 21 is an exploded perspective view of a handle assembly of the mobile computer workstation;

FIG. 22 is a perspective view of the handle assembly;

FIG. 23 is an exploded perspective view of a monitor support assembly of the mobile computer workstation;

FIG. 24 is a perspective view of the monitor support assembly;

FIG. 25 is a perspective view of the mobile computer workstation with a foldable, dual-monitor mounting bracket assembly in a use position according to the principles of the present disclosure;

FIG. 26 is a perspective view of the foldable, dual-monitor mounting bracket assembly in a folded position according to the principles of the present disclosure;

FIG. 27 is a plan view of a folding mechanism of the foldable, dual-monitor mounting bracket assembly in the folded position;

FIG. 28 is an exploded perspective view of a tray assembly of the mobile computer workstation;

FIG. 29 is a partial exploded perspective view of the tray assembly;

FIG. 30 is a partial exploded perspective view of the tray assembly;

FIG. 31*a* is a top view of the tray assembly with the upper tray cover removed and showing a lower tray housing, a tray controller and a keyboard tray assembly of the mobile computer workstation, and showing the expansion wall of the tray assembly in a first position;

FIG. 31*b* is a top view of the tray assembly similar to that of FIG. 31*a* but showing the expansion wall of the tray assembly in a second position;

FIG. 32 is a front perspective view of the tray assembly and also showing the keyboard tray assembly;

FIG. 33 is a partial side view of the mobile computer workstation showing the tray assembly and the keyboard tray assembly;

FIG. 34 is an enlarged detail view of a portion of the mobile computer workstation according to the principles of the present disclosure showing an exemplary tray controller;

FIG. 35 is an perspective view of the keyboard tray assembly of the mobile computer workstation including an auxiliary work surface according to the principles of the present disclosure.

DETAILED DESCRIPTION

The following description is merely exemplary in nature and is not intended to limit the present disclosure, application, or uses.

Figure 1:
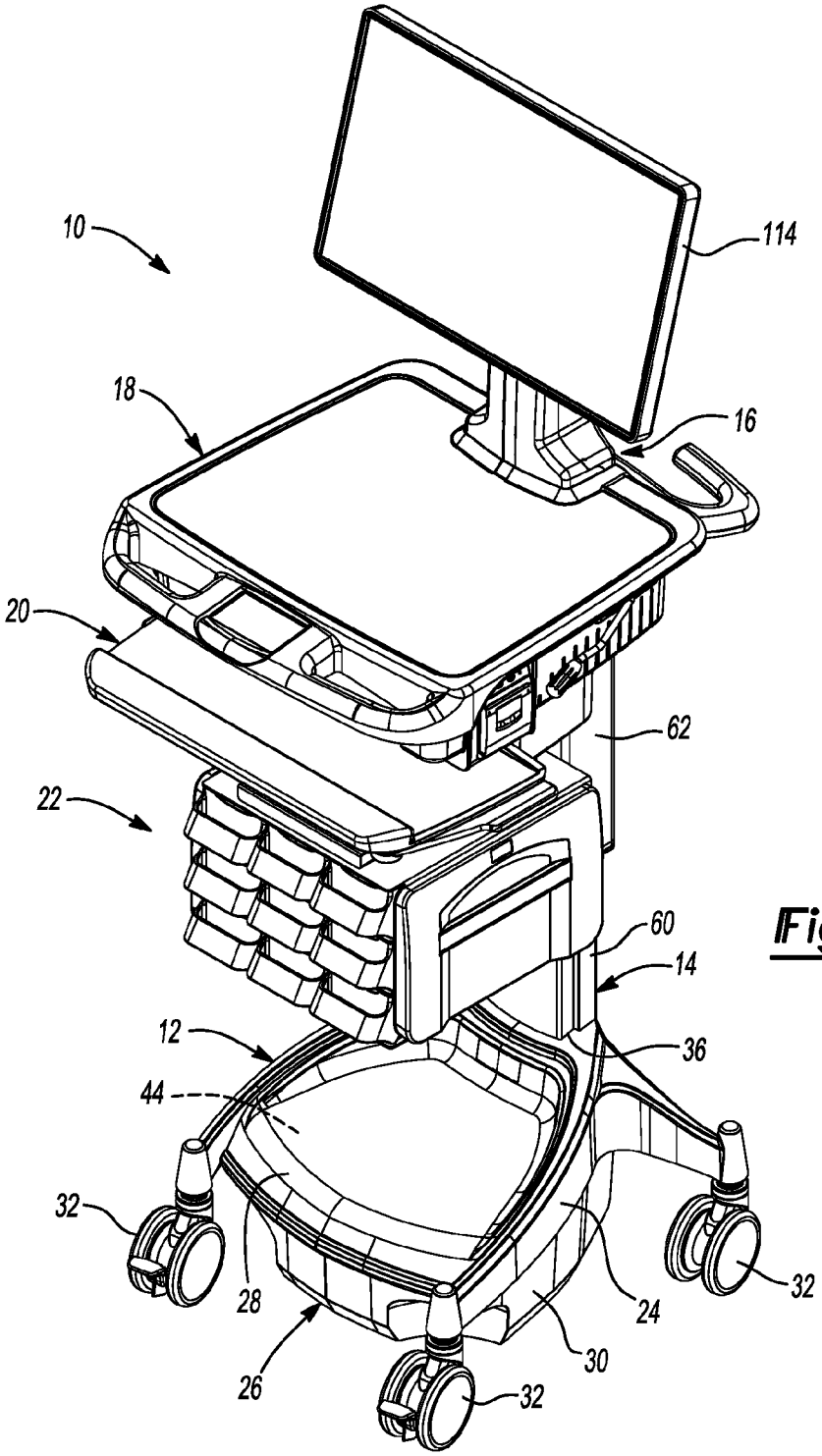
FIG. 1 is a perspective view of a mobile computer workstation according to the principles of the present disclosure.
Figure 2:
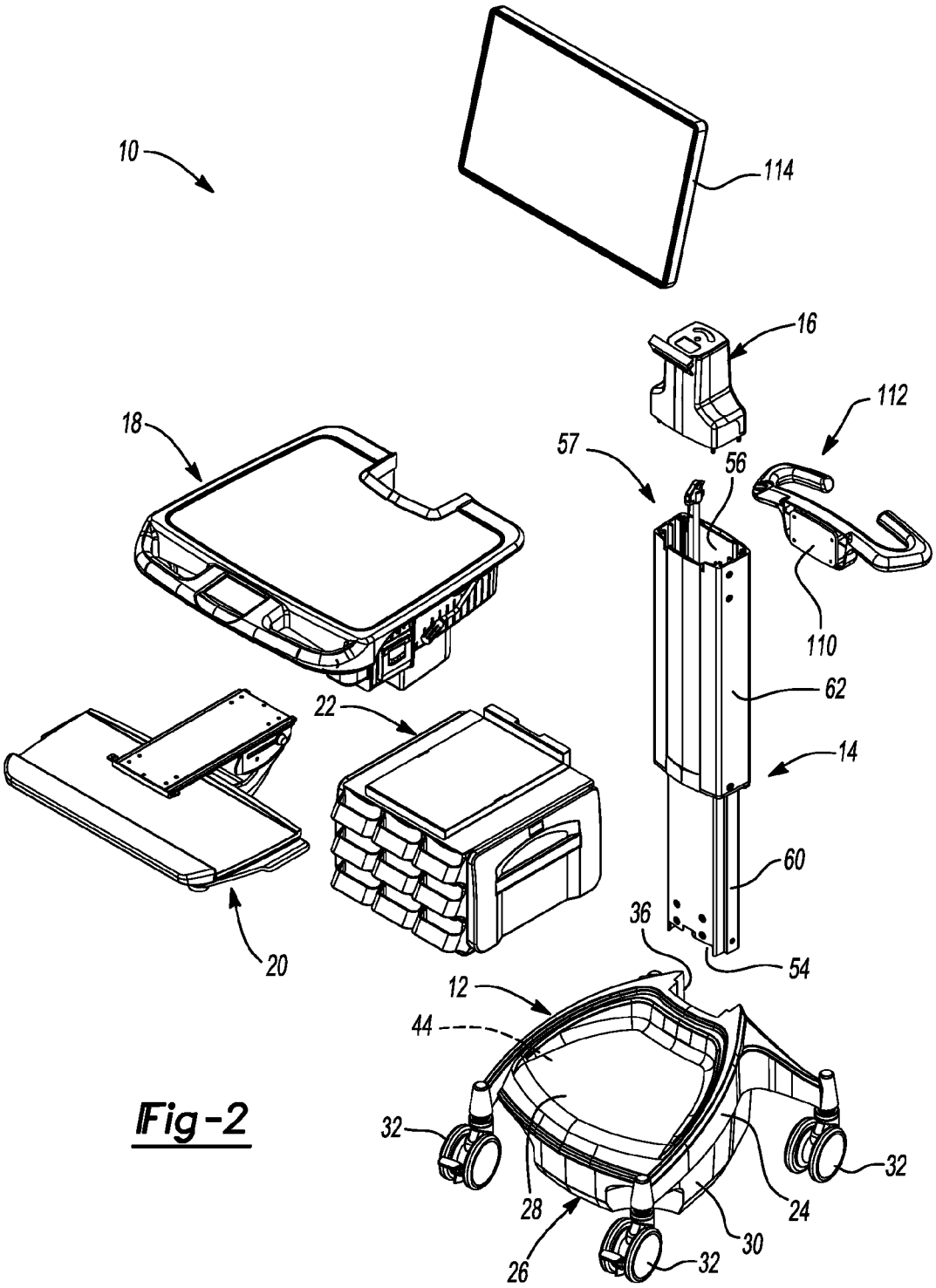
FIG. 2 is an exploded perspective view of the mobile computer workstation of FIG. 1.
Figure 3:
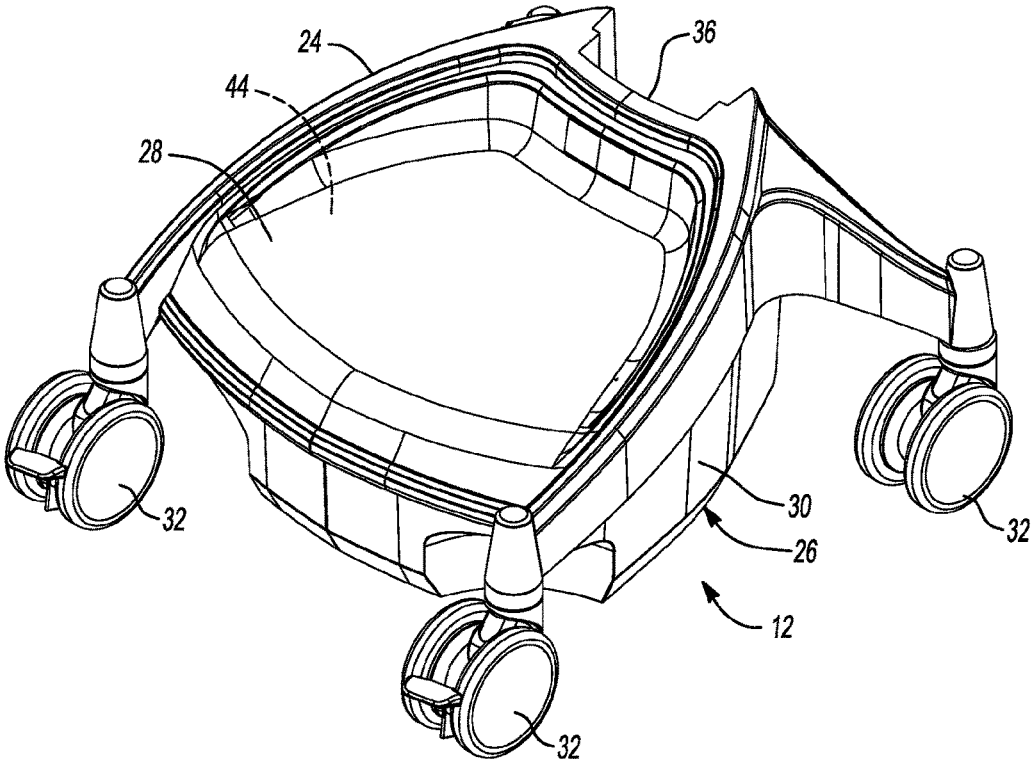
FIG. 3 is a perspective view of a base assembly of the mobile computer workstation.
Figure 4:
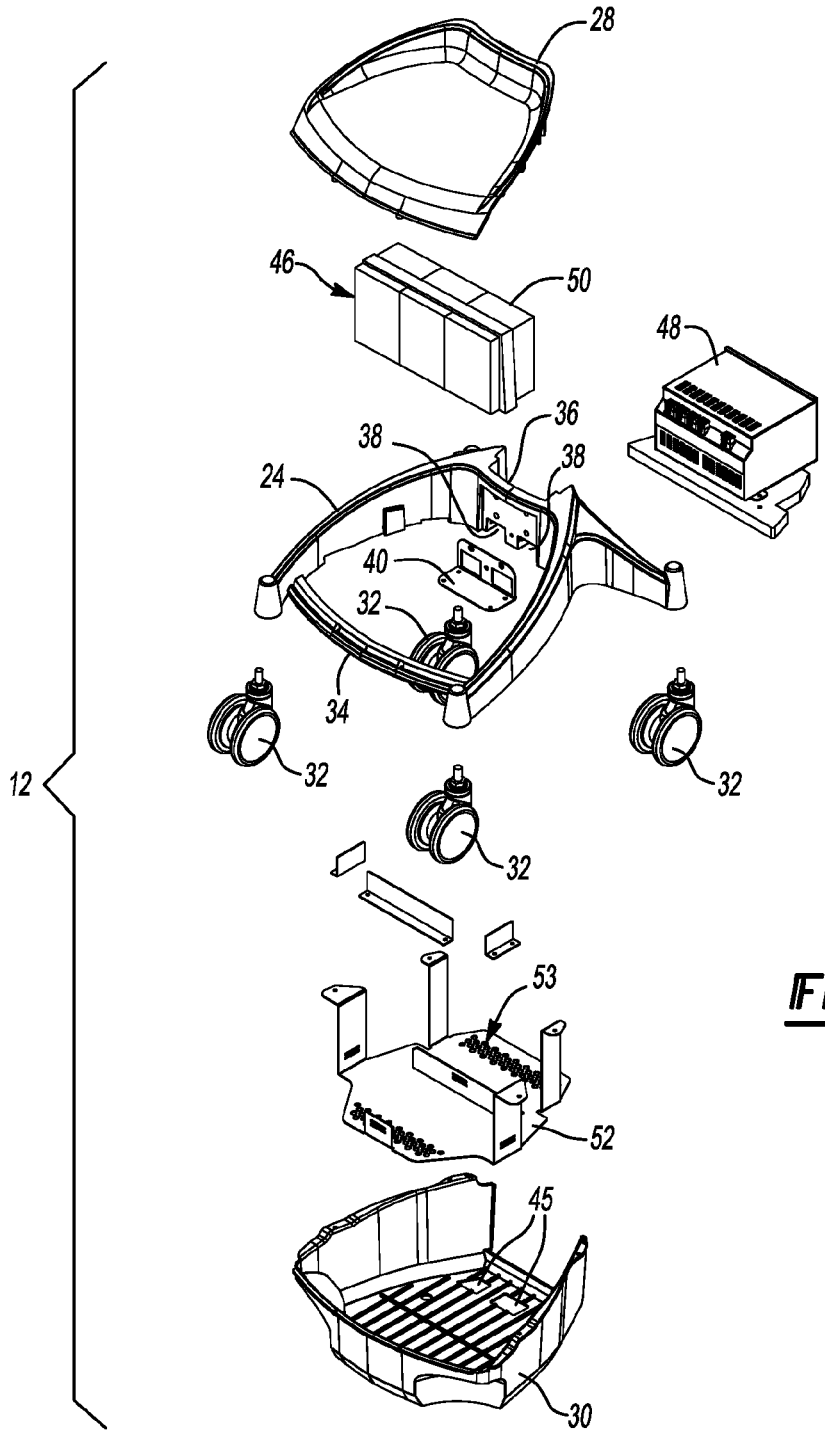
FIG. 4 is an exploded perspective view of the base assembly.

A mobile computer workstation ("workstation") 10 according to the present disclosure can be applied to a variety of applications in a variety of health care, commercial, and industrial settings, as well as other work environments. As shown in FIGS. 1 and 2, the workstation 10 may include a base assembly 12, an adjustable column assembly 14, a monitor support assembly 16, a tray assembly 18, a keyboard tray assembly 20 and a storage module 22. Work settings in which the workstation 10 can be utilized include, but are not limited to, inventory control applications, maintenance applications, diagnostic applications, food service applications, quality control applications where, for instance, sampling and/or statistical analyses can take place, loading dock shipping and receiving applications, manufacturing assembly/parts tracking applications, pharmaceutical manufacturing and/or dispensing applications, or portable point-of-sale location applications. One type of workstation that is contemplated is a point-of-care ("POC") workstation, which can be specifically adapted for use in a medical facility, such as a hospital.

In a workstation equipped with an on-board computer, real time information exchange at a point-of-care can be accomplished. In such applications, selections, decisions, corrections, detections and data entry are all possible with the workstation of the invention.

When the workstation is used to its fullest advantage, general areas such as safety, control, and authorization are improved or made more efficient. Because real time records are capable of being recorded, redundancy in data or tasks can be reduced. For instance, information can be immediately and accurately exchanged, or when work is performed, charges associated with such work can be immediately issued. To accomplish such real-time information exchange, the workstation, and more specifically, the on-board computer system, can communicate, for example, with a central computer or a local area network for the facility within which the workstation is utilized.

Such communications can be by wired or wireless communications means. Various wireless communications protocols can be incorporated into and used with the workstation and its on-board computer system. For instance, well-known wireless communications protocols including IEEE 802.11 and Bluetooth® can be used. Any peripherals associated with the communications, such as network adapters and routers, for example, can be located within the workstation or integral with the workstation's on-board computer.

Figure 5:
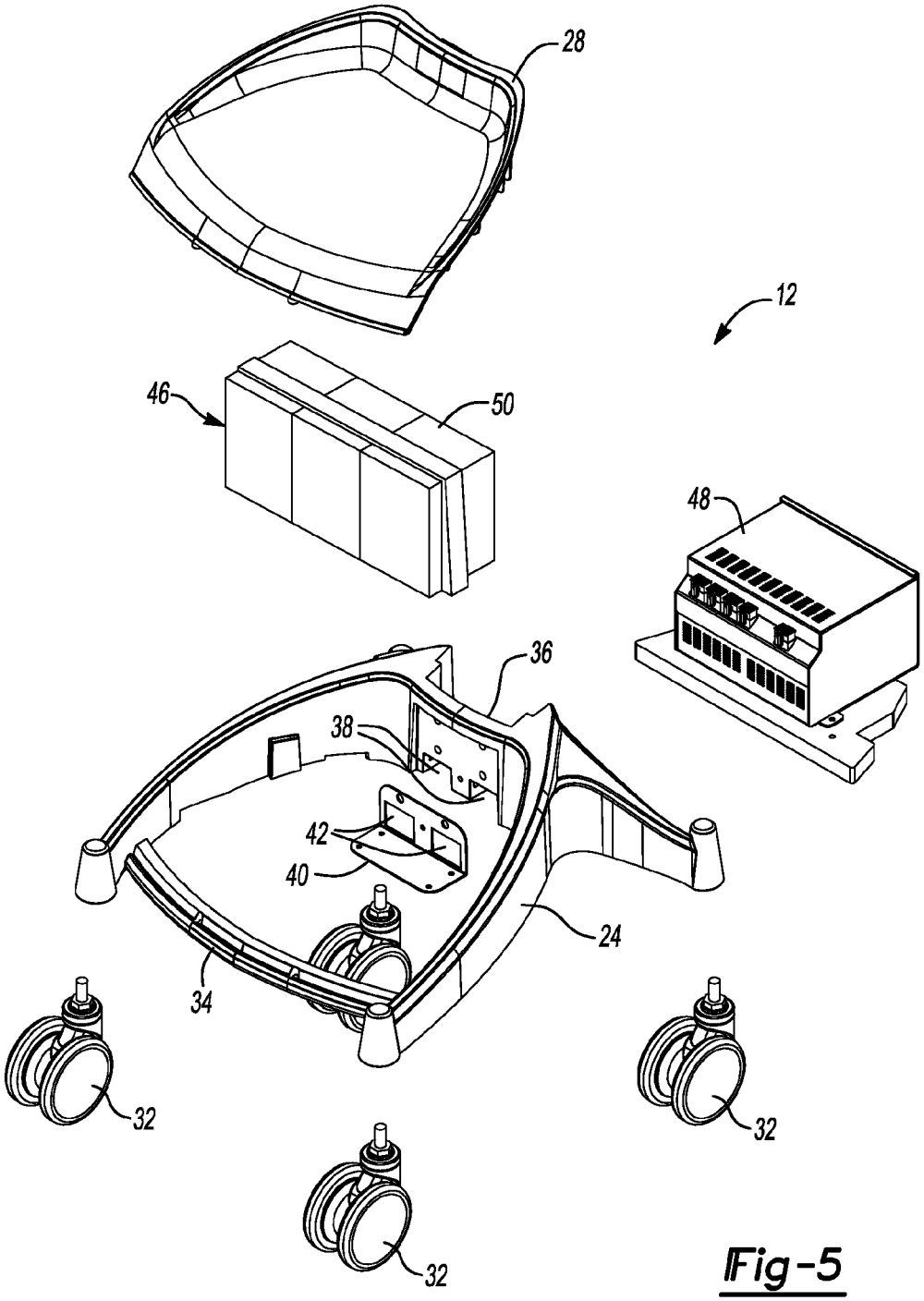
FIG. 5 is a partial exploded perspective view of the base assembly.
Figure 6:
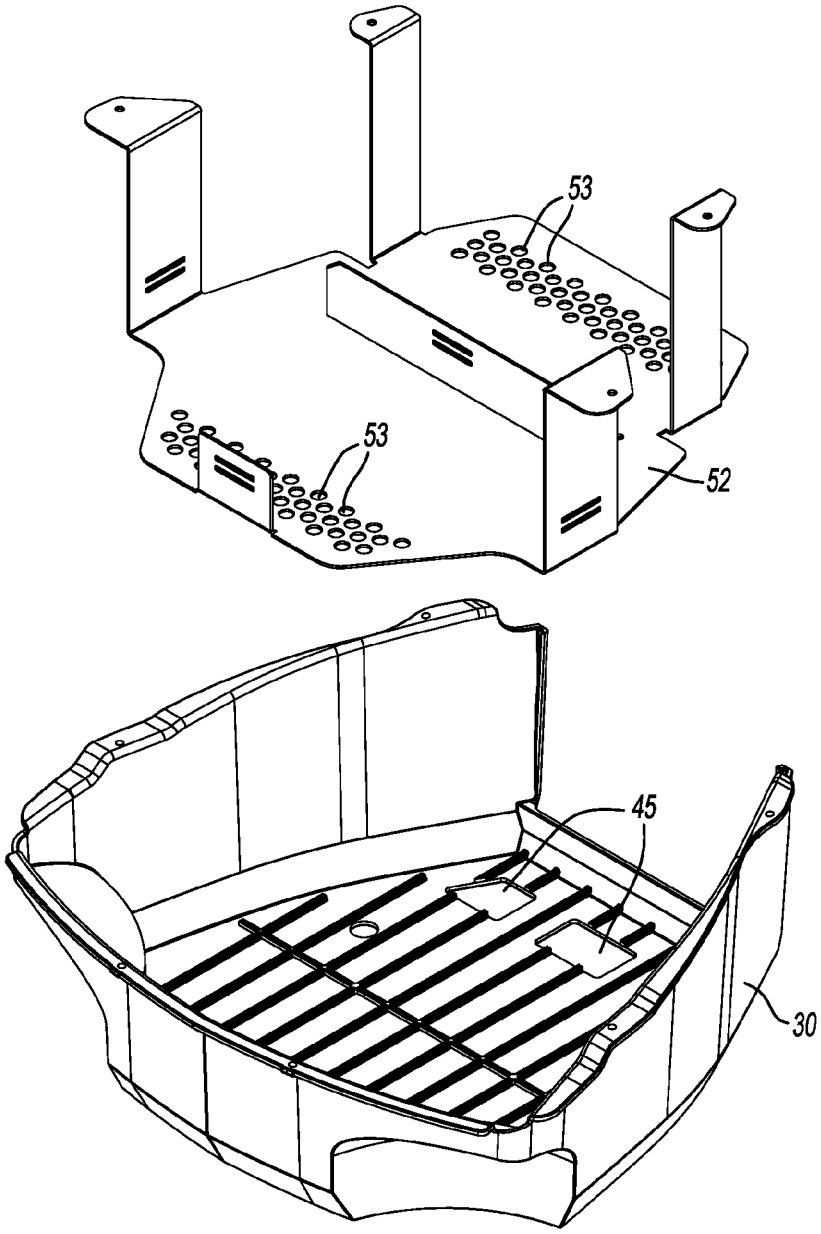
FIG. 6 is a partial exploded perspective view of a housing of the base assembly.
Figure 7:
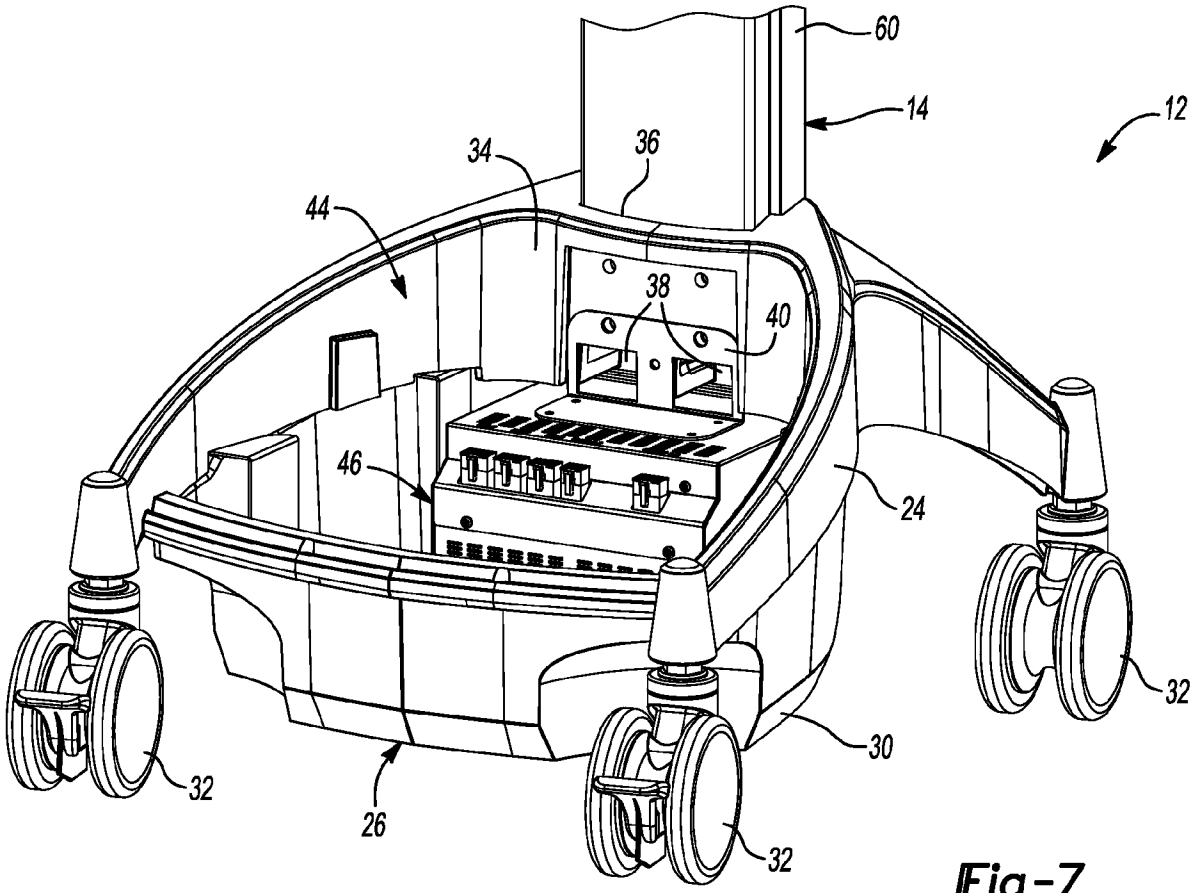
FIG. 7 is a perspective view of the base assembly with a top cover of the housing removed.

Referring now to FIGS. 1-7, the base assembly 12 may include a chassis frame 24, a housing 26 having upper and lower covers 28, 30, and a plurality of casters or wheels 32, such as two front wheels and two rear wheels. As shown in FIGS. 5 and 7, the chassis frame 24 may define a main opening 34, a channel 36 and one or more passages 38 extending between the channel 36 and the main opening 34. In some configurations, an L-shaped bracket 40 (FIG. 5) may be attached to the chassis frame 24 that includes one or more openings 42 that define the passages 38. As shown in FIG. 1, the adjustable column assembly 14 may be received in the channel 36 and secured to the chassis frame 24 by fasteners, snap fit, press fit, welding and/or any other attachment method. The wheels 32 can be attached to an underside of the chassis frame 24. One or more of the wheels 32 can include additional features like a lock pedal and swiveling capability, which can be used in any combination to facilitate desired motion and maneuvering capabilities of the workstation 10.

The housing 26 may be attached to the chassis frame 24 at the main opening 34 such that the lower cover 30 extends downward from an underside of the chassis frame 24. The upper cover 28 may be attached to the chassis frame 24 and/or the lower cover 30. In this manner, the chassis frame 24 and the upper and lower covers 28, 30 cooperate to define a cavity 44. The cavity 44 may be in airflow communication with the channel 36 via the passages 38. The lower cover 30 may include one or more air-inlet passages 45 (FIGS. 4 and 6) through which ambient air can be drawn into the cavity 44.

A power supply 46 can reside within the cavity 44 of the housing 26 and may include, for example, a power adapter and charger 48 and/or one or more rechargeable batteries 50. The power supply 46 provides a compact power supply to all on-board electrical components, such as but not limited to a computer, monitor, peripherals, the adjustable column assembly 14, tray controller, storage module (if equipped), lights, and/or indicators. In some configurations, the power supply 46 has a plurality of independently replaceable batteries. The power adapter and charger 48 efficiently charges the batteries while maximizing the useful life of the batteries. The power supply 46 is scalable (e.g., it can be expanded or contracted in size and power) by increasing or decreasing the number of batteries included in the power supply 46. If supplied with AC power, the power supply 46 charges the batteries 50 and can provide DC power to the workstation 10, the on-board computer and any peripherals notwithstanding the charge level or condition of its batteries. The power adapter and charger 48 and batteries 50 are supported on a power supply support bracket 52 (FIGS. 4 and 6) that is mounted to the chassis frame 24. The bracket 52 may include vent openings 53 to facilitate air flow through the cavity 44.

The power supply 46 and method for its operation and use provides for numerous beneficial features and advantages. For instance, a battery gauge included in the tray controller, can provide a user-detectable output such as, for example, a series of light emitting diodes (LEDs) representing various stages of battery charge such as 100%, 80%, 60%, 40%, 20%, and CHECK BATTERY, for example. A CHECK BATTERY feature can provide a visual or audible indication to a user if a low-battery condition is detected with any of the batteries 50 and/or if a problem is detected with the batteries 50 or the power adapter and charger 48.

Figure 9:
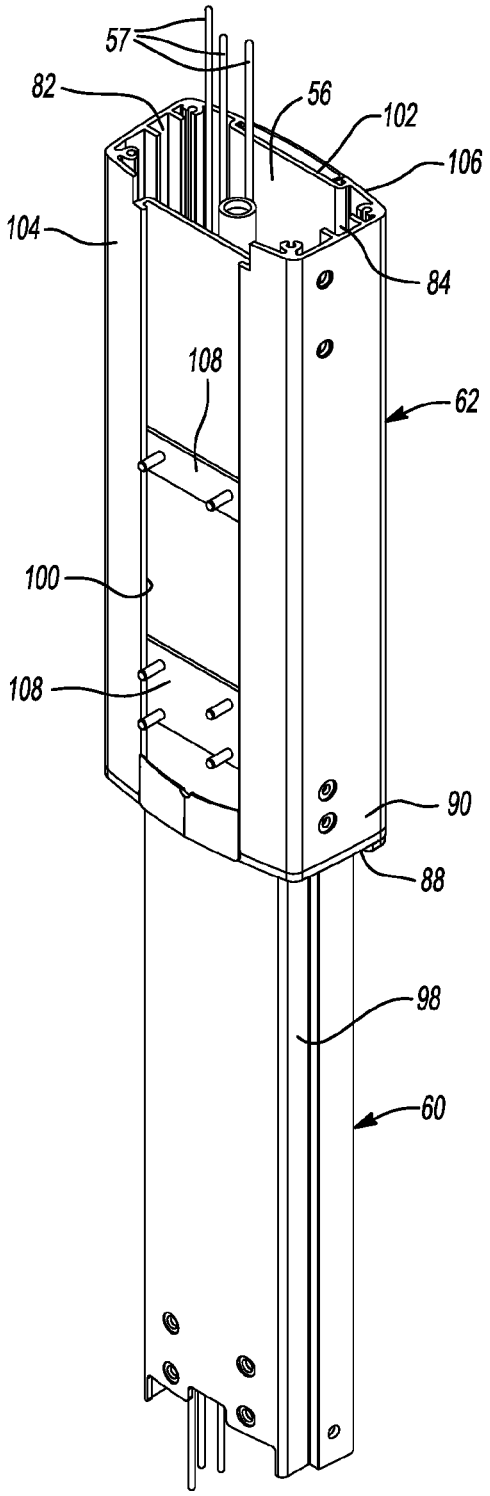
FIG. 9 is a perspective view of an adjustable column assembly of the computer workstation.

The power supply 46 generates heat during operation. The heat generated by the power supply 46 may be vented from the cavity 44 of the housing 26 through the passages 38 and up through first and second vertically extending channels 54, 56 of the adjustable column assembly 14. The air-inlet passages 45 in the lower cover 30 may allow air from outside of the workstation 10 to be drawn into the cavity 44 to facilitate air flow and heat venting from the cavity 44 to the channels 54, 56. Cords, cables and/or wires 57 (FIGS. 9 and 10) can also be routed from the power supply 46 through the passages 38 and channels 54, 56 to various electrically powered devices of the workstation 10.

Figure 8:
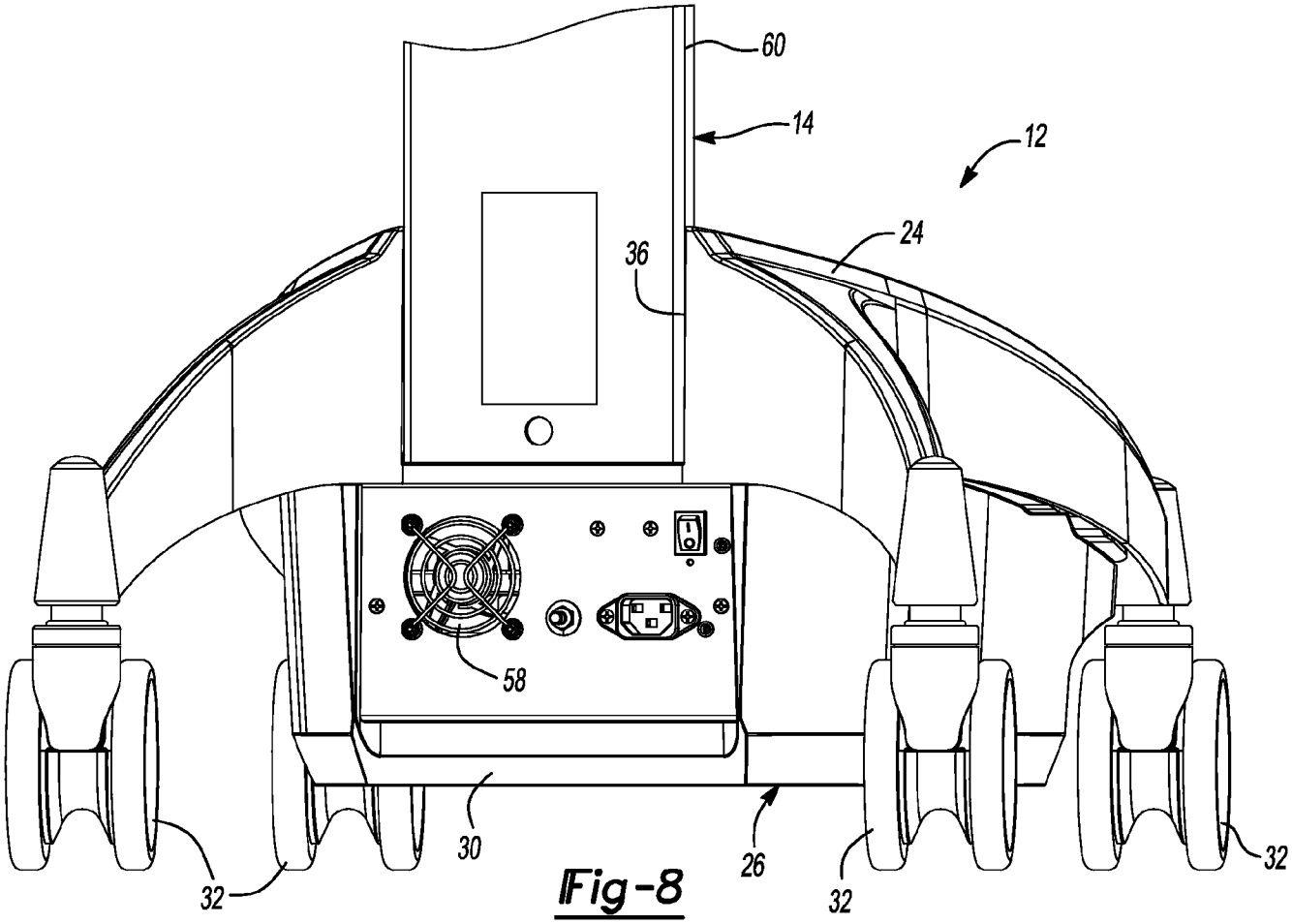
FIG. 8 is a rear perspective view of the base assembly.

As shown in FIG. 8, the base assembly 12 may include a cooling fan unit 58 disposed in an opening in the lower cover 30 of the housing 26. The fan unit 58 may be powered by the power supply 46 and may be operable to spin in a first direction to exhaust hot air from the cavity 44 to the ambient environment and/or spin in a second direction to draw cool air from the ambient environment into the cavity 44. The power supply 46 has at least two operating modes—a fan-on mode and a fan-off (i.e., fan-less) mode. In the fan-on mode, the fan unit 58 may spin in either of the first and second directions to cool to the power supply 46. In the fan-off mode, the fan unit 58 may be turned off so that the fan unit 58 does not disturb the ambient environment around the workstation 10. For example, some uses of the workstation 10 include operation of the workstation within sensitive environments, where operation of a fan could contaminate the ambient air with dust and/or unacceptable air current. In such environments, the power supply 46 can be operated in the fan-off mode so as not to disturb the ambient environment. The power supply 46 can still effectively charge the batteries 50 and/or supply electrical power to the various electrically powered devices of the workstation 10 so that the workstation 10 can operate normally in the fan-off mode. As described above, heat from the power supply 46 is vented from chamber 44 of the housing 26 through the passages 38 and the first and second vertically extending channels 54, 56 of the adjustable column assembly 14. This is particularly advantageous when the power supply 46 is operating in the fan-off mode, as venting heat through the passages 38 and channels 54, 56 provides a means for cooling the power supply 46 that is operable with or without operation of the fan unit 58.

Figure 10:
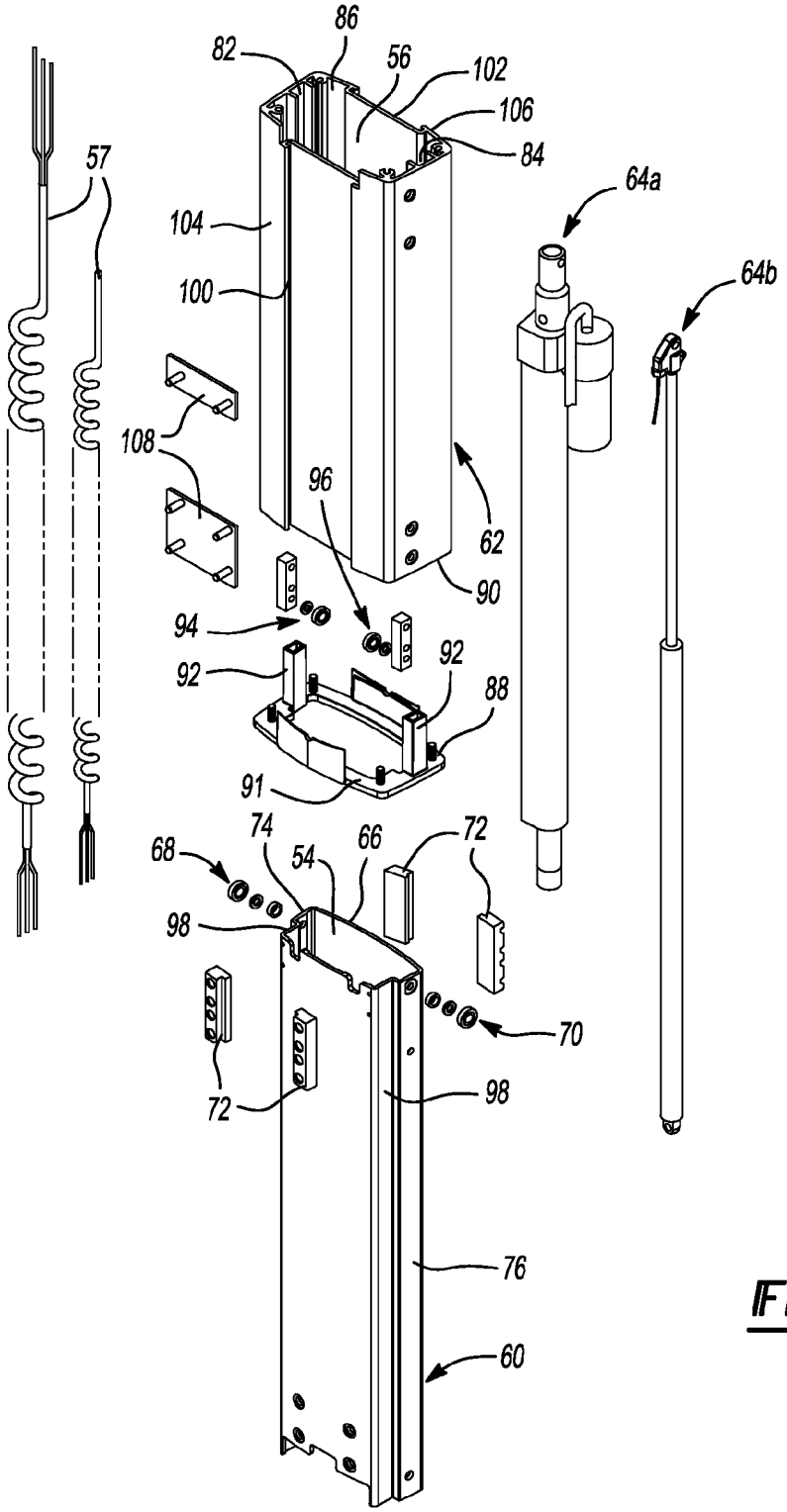
FIG. 10 is an exploded perspective view of the adjustable column assembly.
Figure 12:
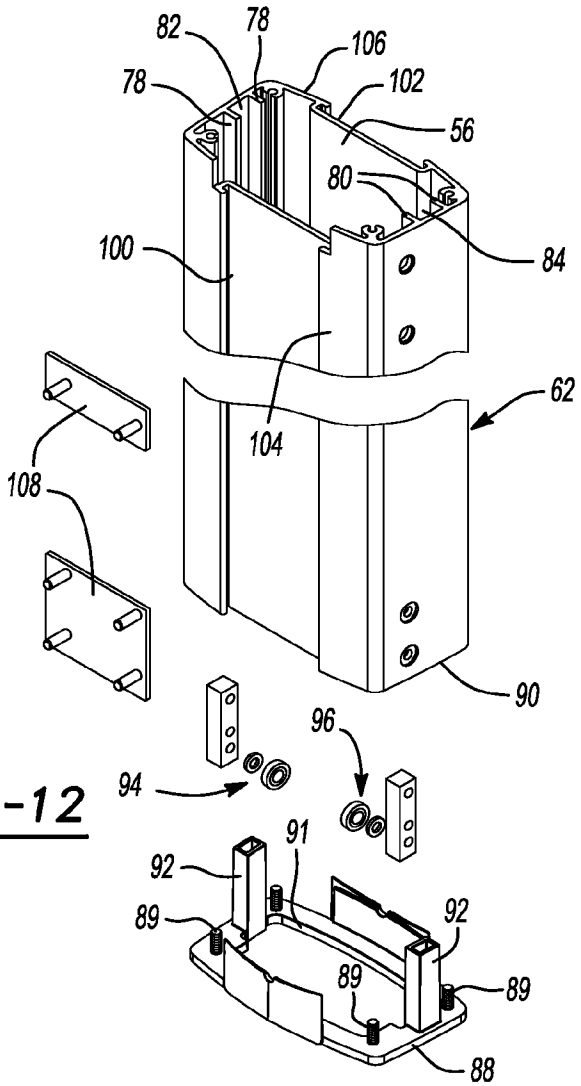
FIG. 12 is a an exploded view of the upper column of the adjustable column assembly.
Figure 11:
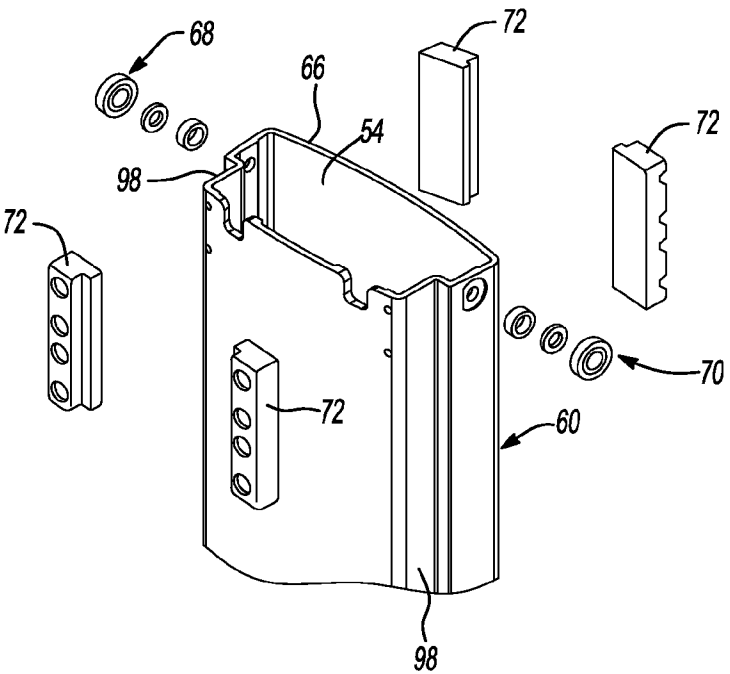
FIG. 11 is an exploded view of a lower column and a plurality of bearings of the adjustable column assembly.
Figure 13:
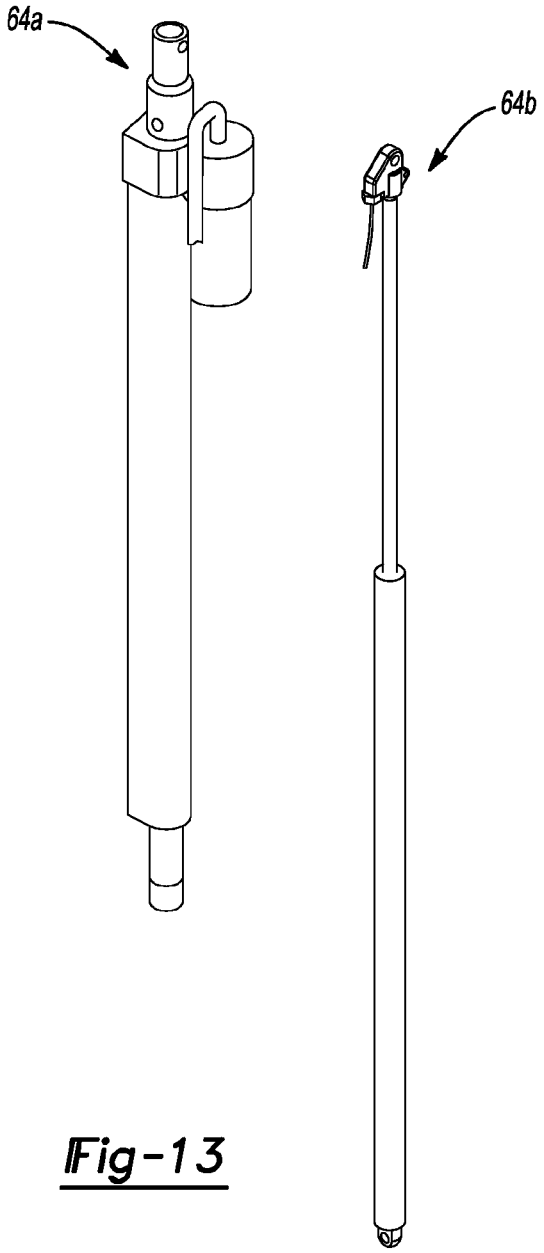
FIG. 13 is a perspective view of exemplary actuators for the adjustable column assembly.

Referring now to FIGS. 9-20, the adjustable column assembly 14 may include first and second columns 60, 62 and a lift mechanism 64*a* (or optionally a lift mechanism 64*b* instead of the lift mechanism 64*a*), as shown in FIG. 10. The column assembly 14 is attached to the base assembly 12 and supports the monitor support assembly 16, the tray assembly 18, the keyboard tray assembly 20 and the storage module 22. The column assembly 14 is operable to raise and lower a height of the monitor support assembly 16, the tray assembly 18, the keyboard tray assembly 20 and the storage module 22 relative to the base assembly 12 to any of a plurality of positions according to any given user's preference (as shown in FIG. 20).

Figure 14:
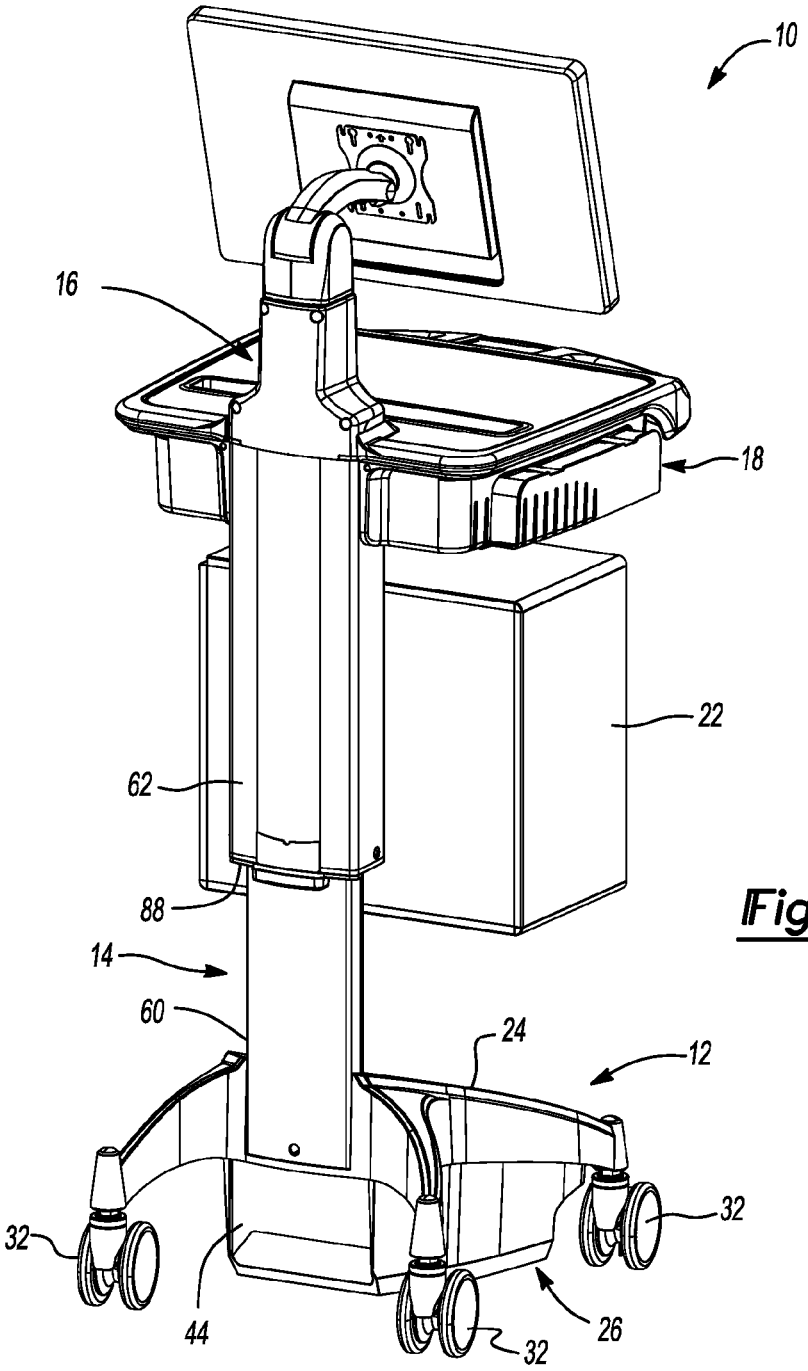
FIG. 14 is a rear perspective view of the mobile computer workstation with the monitor removed.
Figure 16:
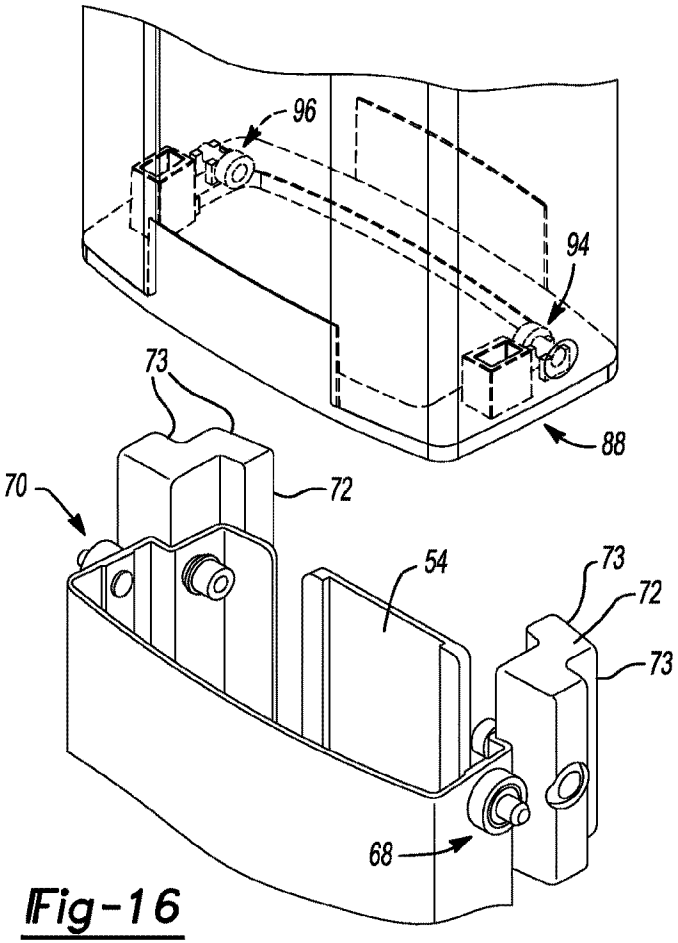
FIG. 16 is a partially exploded perspective view the adjustable column assembly.
Figure 15:
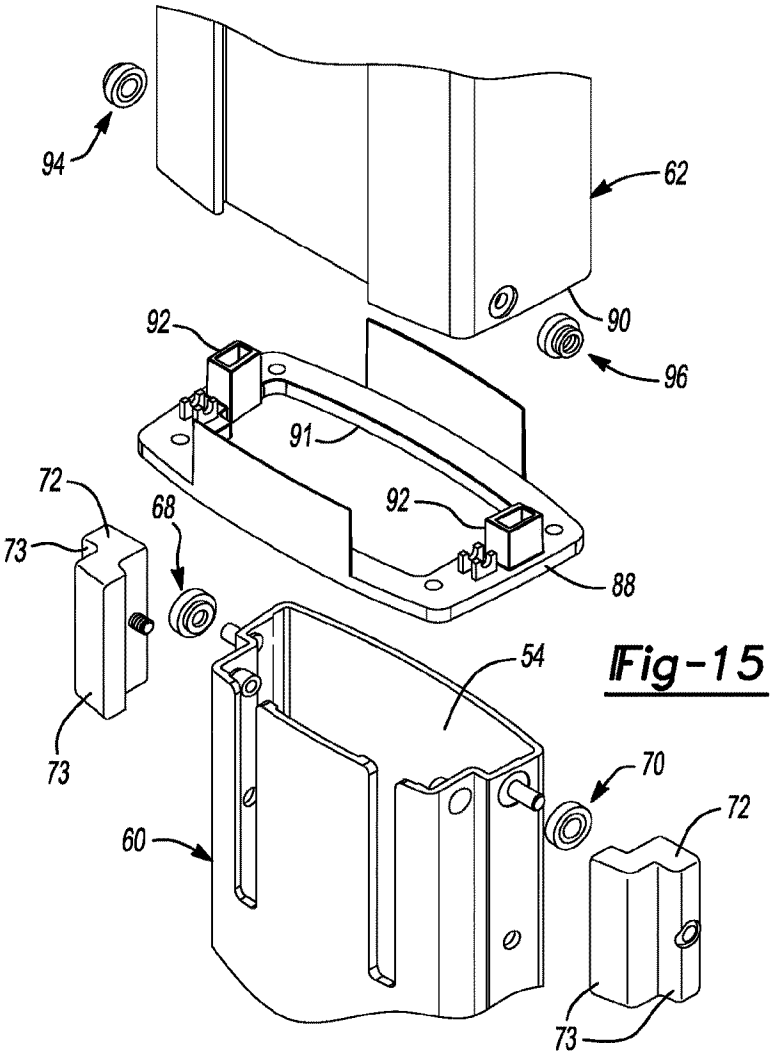
FIG. 15 is a partial exploded perspective view of the adjustable column assembly.

The first column 60 may be received in the channel 36 of the chassis frame 24 of the base assembly 12 and fixed to the chassis frame 24, as shown in FIGS. 1 and 14. The first column 60 includes the first channel 54 extending therethrough. As described above, the first channel 54 is in air flow communication with the cavity 44 of the base assembly 12 via the passages 38. An upper end 66 of the first column 60 may include first and second roller bearings 68, 70 and a plurality of spacers or linear bearings 72. In the configuration depicted in FIGS. 10 and 11, the first and second roller bearings 68, 70 are attached to and extend laterally outward from respective first and second exterior lateral sides 74, 76 of the first column 60. The linear bearings 72 may be disposed at or near the lateral sides 74, 76 and extend outward from the exterior of the first column 60. FIGS. 15-18 depict another configuration of the linear bearings 72 in which the linear bearings 72 extend laterally outward from the lateral sides 74, 76 and include steps 73.

The second column 62 includes the second channel 56 and telescopically receives the first column 60 in the second channel 56. The second column 62 may include first and second pairs of parallel guide rails 78, 80 (FIG. 12) that extend inward into the second channel 56 and extend between upper and lower ends of the second column 62. The first pair of guide rails 78 define a first lateral channel 82. The second pair of guide rails 80 define a second lateral channel 84. The first and second roller bearings 68, 70 of the first column 60 may be received in the first and second lateral channels 82, 84, respectively, and may roll therein to facilitate movement of the second column 62 relative to the first column 60. The linear bearings 72 may slide against interior walls 86 of the second column 62 that define the second channel 56. The linear bearings 72 nest between the exterior of the first column 60 and the interior of the second column 62 and fill any gap therebetween to minimize any play between the first and second columns 60, 62. The contact between the linear bearings 72 and the interior of the second column may also improve the torsional rigidity (i.e., rigidity in a torsional direction about a longitudinal axis of the column assembly 14) of the column assembly 14.

A filler member 88 may engage a lower end 90 of the second column 62 and may be partially received in the second channel 56. The filler member 88 may be fixed to the second column 62 by a press fit, snap fit and/or fasteners 89 (FIG. 12), for example. The filler member 88 may include a central opening 91 and a pair of posts 92. The opening 91 may be sized to allow the first column 60 to extend therethrough but prevent the linear bearings 72 from passing therethrough. The posts 92 may be disposed on opposite sides of the opening 91 and may be received in the first and second lateral channels 82, 84 of the second column 62 to act as hard stops that abut the linear bearings 72 to prevent the second column 62 from sliding off of the upper end 66 of the first column 60. Third and fourth roller bearings 94, 96 may extend into the second channel 56 and may roll along exterior surfaces 98 of the first column 60 as the second column 62 moves vertically relative to the first column 60. The roller bearings 68, 70, 94, 96 bear the load of the second column 62.

The second column 62 may also include first and second exterior channels or dovetails slots 100, 102 formed in first and second exterior surfaces 104, 106. The first exterior channel 100 may receive brackets 108 to which the tray assembly 18 and/or storage module 22 may be attached. The second exterior channel 102 may receive a bracket 110 of a handle assembly 112 (shown in FIGS. 2, 21 and 22). The brackets 108, 110 are slidably movable within the channels 100, 102 and can be clamped or otherwise selectively fixed in a desired vertical position.

The lift mechanism 64*a*, 64*b* adjusts the vertical length of the column assembly 14 (i.e., a vertical position of the second column 62 relative to the first column 60) to establish and control the vertical positioning of the monitor support assembly 16, tray assembly 18, keyboard tray assembly 20, storage module 22 and handle assembly 112, as desired by the user. Such adjustment can be accomplished by the user under power supplied by power supply 46 of the workstation 10. The lift mechanism 64*a*, 64*b* can include a motorized, hydraulically, or pneumatically driven device, for example. The device can incorporate a gear mechanism, a ball screw mechanism, a spring, a piston, a cable, a spool, a pulley and similar types of structures or components. Alternatively, the lift mechanism 64*a*, 64*b* can include a balancer device that enables the user to adjust the position of the second column 62 under force supplied by the user. One end of the lift mechanism 64*a*, 64*b* can be attached to the base assembly 12 or the first column 60, and the other end of the lift mechanism 64*a*, 64*b* can be attached to the second column 62 or the monitor support assembly 16, for example.

Referring now to FIGS. 1, 2, 23 and 24, the monitor support assembly 16 may be mounted to the upper end of the second column 62 and may support one or more monitors 114. In the configuration shown in FIGS. 23 and 24, the monitor support assembly 16 may include first and second shell portions 116, 118 that cooperate to form a cavity 120 therebetween. The first and second shell portions 116, 118 may engage each other by a snap fit and/or fasteners, for example. The cavity 120 is in communication with the channels 54, 56 of the column assembly 14 so that a monitor cable 122 can extend through one or both of the channels 54, 56 and into the cavity 120.

The first shell portion 116 may include an opening 124 in communication with the cavity 120. The opening 124 may receive a cable connector 126 (e.g., an HDMI connector, a VGA connector, a DVI connector, etc.) attached to the monitor cable 122. In some configurations, the cable connector 126 may be fixedly received in the opening 124. A bracket 128 may be attached to the first and second shell portions 116, 118. The monitor 114 may be attached to the bracket 128 using one or more threaded fasteners, for example. The bracket 128 may enable the position or orientation of the monitor 114 to be adjusted to accommodate the preference of a user.

Referring now to FIGS. 25-27, another monitor mounting bracket assembly 130 is provided. The mounting bracket assembly 130 may be attached to the first and second shell portions 116, 118 of the monitor support assembly 16 (instead of or in addition to the bracket 128), or in some configurations, the mounting bracket assembly 130 may be mounted directly to the second column 62 or the tray assembly 18, for example. The monitor mounting bracket 130 may support first and second monitors 132, 134 and is operable to move the monitors 132, 134 between a use configuration (FIG. 25) and a folded configuration (FIGS. 26 and 27). In the folded configuration, the monitors 132, 134 may block less of the user's field of view beyond the workstation 10 compared to the use configuration, which may improve the maneuverability of the workstation 10.

The mounting bracket assembly 130 may include a folding mechanism 140 and first and second brackets 142, 144. The first and second monitors 132, 134 can be mounted to the first and second brackets 142, 144, respectively. The folding mechanism 140 is operable to move the first and second brackets 142, 144 and the first and second monitors 132, 134 between a use configuration (FIG. 25) and a folded configuration (FIGS. 26 and 27). In the folded configuration, screens of the monitors 132, 134 may be parallel or approximately parallel to each other or at least partially facing each other. In the folded configuration, the monitors 132, 134 may block less of the user's field of view beyond the workstation 10 compared to the use configuration.

The folding mechanism 140 may include a base 146 and first and second arms 148, 150 that are movable relative to the base 146 and each other. The first and second brackets 142, 144 are mounted to the first and second arms 148, 150, respectively. As shown in FIG. 27, ends 151 of the first and second arms 148, 150 are rotatably mounted to the base 146 and include gear teeth 152. The base 146 may include a first base plate 154, a second base plate 156 and first and second gears 158, 160. The ends 151 of the first and second arms 148, 150 and the first and second gears 158, 160 may be rotatably mounted between the first and second base plates 154, 156.

The first gear 158 is meshingly engaged with the second gear 160 and with the gear teeth 152 of the first arm 148. The gear teeth 152 of the second arm 148 is meshingly engaged with the second gear 160. In this manner, rotation of one of the arms 148, 150 relative to the base 146 causes corresponding rotation of the other of the arms 148, 150 relative to the base 146. Accordingly, a user can move both of the monitors 132, 134 between the folded and use configurations by applying a force to only one of the monitors 132, 134 (or to only one of the brackets 142, 144 or only one of the arms 148, 150) to cause corresponding movement of both of the monitors 132, 134.

In some embodiments, in addition to the folding mechanism 140, each of the brackets 142, 144 are adjustable so that a user can customize the positioning of the monitors 132, 134 in the use configuration. For example, each of the brackets 142, 144 may include a post 162 and a beam 164. Each of the posts 162 may be received in a corresponding collar 166 mounted to a corresponding one of the arms 148, 150 and may extend vertically upward therefrom. A locking device may selectively prevent and allow rotation of the posts 162 within the collars 166. Each of the beams 164 may be attached to a corresponding one of the posts 162 and may be selectively movable relative to the posts 162. Clamping devices may selectively allow and prevent movement of the beams 164 relative to the posts 162. Slide members 168 may connect the monitors 132, 134 with corresponding beams 164. The slide members 168 may be selectively movable within tracks 170 in the beams 164. In some embodiments, the monitors 132, 134 may be pivotably attached to the slide members 168 by a pivotable connection (e.g., by a ball-and-socket connection). In this manner, the monitors 132, 134 can be positioned in a desired manner to suit a given user.

In some embodiments, the workstation 10 can include a storage module 22 that can house a variety of cassette bins or drawers. The cassette bins are removable as a unit as a cassette assembly, or individually removable from the cassette assembly. In a medical environment, such as a hospital, the cassette bins can store pharmaceuticals and medical supplies and other work-related items.

The storage module 22 can be configured with a variety of storage solutions to enable the workstation 10 to be suitable for any of a number of work environments and tasks. For example, storage module 22 can integrate any combination of drawers, trays, shelves, and storage cassettes and bins, among others.

In yet other embodiments, the workstation 10 may include a tray assembly 18 as described above. Referring to FIGS. 28-35, the tray assembly 18 provides the workstation 10 with an ample work surface 204. The tray assembly 18 has an upper tray cover 206 that can be used as a general work surface. The upper tray cover 206 may include a handle 212. The handle 212 is arranged so a user of the workstation 10 may grasp the handle 212 in order to push or pull the workstation 10 from location to location.

A technology compartment 208 is located in an interior cavity of the tray assembly 18 beneath the work surface 204. The technology compartment 208 is formed of a lower tray housing 210. The lower tray housing 210 is configured to receive components of the tray assembly 18. For example, the upper tray cover 206 is configured to close over the lower tray housing 210 in order to enclose the components of the tray assembly 18.

A computer 216 can be located in the technology compartment 208, which is located beneath the work surface 204 in an interior cavity of the tray assembly 18. Regarding applicable computers that are suitable for use with the workstation 10, it should be noted that the workstation 10 is not limited to any particular brand or type of computer. For example, if the workstation 10 is being used in a hospital, whatever approved or preferred brand or type of computer that such hospital utilizes can be incorporated in the workstation 10. More specifically, as an example, the computer 216 can be a laptop computer or a computer that lies flat on a computer shelf 220. As an alternative, the workstation 10 can incorporate an "all-in-one"-type (AIO) computer, like a tablet PC, for example, having a display screen that is integrated within a housing of the computer and that is configured to be mounted at the monitor support assembly 16 in place of the monitor 114. As such the AIO computer serves in the capacity of both the computer and monitor.

In one embodiment, the computer 216 is connected to the computer monitor 114. The user utilizes the computer monitor 114 as described above. In another embodiment, the computer 216 is a laptop computer equipped with an integrated display screen. The upper tray cover 206 may include a monitor slot 218. When the computer 216 is a laptop computer, the integrate display screen passes through the monitor slot 218 when the upper tray cover 206 is closed over the lower tray housing 210. It is understood that when the workstation 10 comprises a laptop computer with an integrated display screen and a computer monitor 114, the workstation 10 may utilize the integrated display screen, the computer monitor 114, or both the integrated display screen and the computer monitor 114. Further, the workstation 10 may not include the computer monitor 114 when the computer 216 is a laptop computer.

The technology compartment 208 is expansible to accommodate different sized computers with the inclusion of an expansion wall 224. The expansion wall 224 can increase the size and volume of the technology compartment 208 of the tray assembly 18, as shown in FIGS. 28-31. For example, the expansion wall 224 may slide into an opening in at least one side 211*a* and side 211*b* of the lower tray housing 210. The opening is configured to receive the expansion wall 224. For example, as illustrated in FIGS. 31*a* and 31*b*, the opening allows the expansion wall 224 to slide into the lower tray housing 210. When fully engaged (i.e., pushed in), the expansion wall 224 is enclosed within the lower tray housing 210. In other words, the expansion wall 224 does not protrude from the lower tray housing 210.

In order to accommodate a wide range of computer dimensions, the expansion wall 224 may be pulled or slid out of the lower tray housing 210 to a desirable position. For example, the expansion wall 224 may be configured to expand up to several inches (or more, as desirable) beyond an edge of the lower tray housing 210. The expansion wall 224 is configured to maintain the securing of the technology compartment 208 when expanded to accommodate a computer size. Specifically, the expansion wall 224 may be configured to expand to a predefined maximum distance before locking into place. In one example, the expansion wall 224 is configured to include tabs that stop the expansion wall 224 from being removed completely, thereby protecting the computer 16 from unauthorized access.

When the computer 216 is larger than the width of the lower tray housing 210, the expansion wall 224 may be pulled or slid out to allow the computer 216 to fit within the technology compartment 208. It is understood that the expansion wall 224 may be fully pushed in or partially or fully pulled or slid out to accommodate a wide range of computer sizes. In some embodiments, the expansion wall 224 may include indicia correlating to a size of the computer 216. For example, the expansion wall 224 may include indexed tabs on a bottom side of the expansion wall 224. The indexed tabs may be arranged to catch a corresponding indexed notch on a bottom interior surface of the lower tray housing 210. It is well known that computer, such as laptop computers are fitted to standard sizes.

For example, 13 inch, 15 inch, and 17 inch laptops are known. Each size indicated above has a generally standard width to accommodate a display screen size of the laptop. The expansion wall 224 may be configured to accommodate known laptop sizes. For example only, the expansion wall 224 may be pulled out so that one indexed tab is exposed on a bottom side of the expansion wall 224.

In other words, the indexed tab may be pulled from an indexed notched. This may result in a "click" sound. The expansion wall 224 may include instructions printed on a side of the expansion wall 224 instructing the user to move the expansion wall 224 a predefined number of clicks for a specific computer size. By way of non-limiting example, the instructions may instruct the user to pull the expansion wall 224 out two clicks for a 15 in laptop computer. It is understood that while only laptop computers are described, the expansion wall 224 may accommodate any known computing technology such as a desktop computer, netbook computer, notebook computer, or laptop computer. It is also understood that the expansion wall 224 may be expanded to accommodate a plurality of computer peripherals, dongles, and other computer attachments that protrude from a side of the computer. For example, the computer 16 may include a peripheral, such as a mouse. When the mouse is plugged into a port on the computer 16, the mouse attachment may increase the space required to accommodate the computer 16. The expansion wall 224 may be expanded to accommodate the extra required space.

The technology compartment 208 includes a computer shelf 220. The computer 216 is situated and secured on the computer shelf 220 as illustrated in FIGS. 28 and 29. The computer 216 is securely held against the computer shelf 220. This can be accomplished by using Velcro, metal, fabric or plastic strapping to reduce or eliminate movement or vibration experienced during transportation of the workstation 10. The shelf 220 can be vertically adjustable and keeps the computer 216 above the bottom surface of the technology compartment 208 to improve ventilation and circulation of air in the compartment. In some embodiments, the shelf 220 is attached to a shelf bracket 222 as illustrated in FIGS. 28 and 29. The shelf bracket 222 may be attached on an opposed side of the shelf 220 from the computer 216. The shelf bracket 222 is adjustable in order to raise or lower the shelf 220. In other words, the shelf bracket 222 may attach to the shelf 220 in a manner that supports the shelf 220 and allows for ventilation and circulation of air beneath the shelf 220.

In some embodiments, the shelf 220 may be selectively adjustable to allow access to the technology compartment 208 without removing the computer 216 from the shelf 220. As illustrated in FIG. 32, the shelf 220 may include one or more lift mechanisms 223. The lift mechanisms 223 may include a rigid arm extending from a bottom of the shelf 220. In another example, the lift mechanisms 223 may be rigid u-shaped member that connects to the bottom of the shelf 220 at a first connection point and a second connection point. In some embodiments, the lift mechanism 223 may include a friction lock that locks the shelf 220 in an open position. In another embodiment, the lift mechanism 223 includes a locking mechanism including a pivot arm and a pin. For example, the pivot arm may pivot with the shelf 220 relative to the lower tray housing 210. The pin may be slid into an opening beneath the pivot arm, thereby locking the shelf 220 in an open position. The lift mechanisms 223 may rest on a plurality of steps 225 arranged on an inner wall of the lower tray housing 210. For example, the steps 225 may be arranged in a vertical row extended downwardly from the shelf 220 toward a bottom of the lower tray housing 210. When the shelf 220 is in a lowered position the shelf 220 rests flat and generally flushes with the lower tray housing 210.

The shelf 220 may be lifted to a plurality of positions corresponding to each of the steps 225. As illustrated in FIG. 32, the shelf 220 may be maintained in an open position while the at least one lift mechanism 223 is resting on at least one step 225. For example, a first step 225 may be arranged to receive at least one of the lift mechanisms 223. When the lift mechanism 223 rests on the first step 225, the shelf 220 may be at a first angle relative to the lower tray housing 210, such that, access to components housed within the technology compartment 208 may be accessed by the user of the workstation 10. In another example, the lift mechanisms 223 may rest on a second step 225, such that, the shelf 220 may be at a second, greater angle, relative to the lower tray housing 210. It is envisioned that the steps 225 may be arranged to allow the user of the workstation 10 to place the shelf 220 in a desirable position to allow access to the components within the technology compartment without having to remove the computer 216.

In some embodiments, the lower tray housing 210 includes a cable management system 241. The cable management system 214 is arranged at a bottom interior surface of the lower tray housing 210. The cable management system 241 may include a covered channel that allows cables to be fed along the bottom of the interior surface of the lower tray housing 210.

In some embodiments, the technology compartment 208 includes a manual lockset 242 as illustrated in FIGS. 31*a*, 31*b*, and 32. The manual lockset 242 may be manually locked or unlocked by the user of the workstation 10. The manual lockset 242 prevents unauthorized access to the technology compartment 208.

The technology compartment 208 also includes a plurality of vents 228 to improve air circulation. The plurality of vents 228 may be arranged on each at least two opposing sides of the lower tray housing 210. In this manner, air may be drawn in on one side of the lower tray housing 210 and pass through another side of the lower tray housing 210. Further, the plurality of vents 228 may be arranged on the expansion wall 224. It is understood that any ventilation configuration utilizing the plurality of vents 228 in order to adequately ventilate the technology compartment 208 is envisioned by the present disclosure.

Storage wells or bins 232 are included in the bottom of the technology compartment 208. The storage bins 232 can be used for a variety of purposes, such as for storing parts or peripheral components, like an electrical outlet or power inverter. The technology compartment 208 may include one or more bins 232. Further, in some embodiments, the technology compartment 208 does not include the bins 232. In one embodiment, the bins 232 are utilized to house a power outlet 234. The computer 216 may receive power from a dedicated power adaptor. The power adaptor may plug into the power outlet 234 in order to provide power to the computer 216. For example, the computer 216 may be a laptop computer.

It is well known that laptop computers generally receive power from a power adapted configured specifically for the laptop computer. In order to accommodate any variety of power adaptors, the bins 232, including the power outlet 234, may be located near or under the computer 216 in order to receive a power plug associated with the power adaptor. In this manner, the workstation 10 can accommodate any manner of power source required to supply power to the computer 216.

The bins 232 may be inserted into a bin opening 235. As illustrated in FIGS. 28 and 30, multiple bin openings 235 may receive multiple bins 232. The bins 232 include an upper edge 237. The upper edge 237 is arranged to be slightly larger than a lower portion 239 of the bins 232. In this manner, the bins 232 may slide into the bin openings 235 and rest on the upper edge 237. In other words, the upper edge 237 prevents the bins 232 from falling through the bin openings 235. It is understood that while only a power outlet is described, the bins 232 may be used for cable management, component storage, peripheral storage, or any suitable application applicable to the bins 232.

As illustrated in FIGS. 31-34, the keyboard tray assembly 20 is attached at the bottom of the tray assembly 18 and can be positioned at a use position and a stowed position. When the keyboard tray assembly 20 is in the stowed position, the keyboard tray assembly 20 is positioned beneath the lower tray housing 210. When the keyboard tray assembly 20 is in the use position, the keyboard tray assembly 20 is positioned outward from the tray assembly 18.

A computer keyboard can be stored on the keyboard tray assembly 20. The computer keyboard may be secured to the keyboard tray assembly 20 to prevent the keyboard from moving on the keyboard tray assembly 20. In one example, the keyboard is secured to the keyboard tray assembly 20 using Velcro. In other example, the keyboard may be secured to the keyboard tray assembly 20 using a temporary adhesive such as double sided tape, a non-permanent adhesive material, or a rubberized contact surface. It is understood that the keyboard may be secured to the keyboard tray assembly 20 in any suitable manner.

As illustrated in FIG. 33, the keyboard tray assembly 20 includes an assembly arm 264. The assembly arm 264 includes a first pivot point 266 and a second pivot point 268. The first pivot point 266 is operable to pivot a keyboard tray 270 in a plurality of positions according to a user preference. For example, the keyboard tray 270 may be tilted downward, tilted upward, or key generally level with the tray assembly 18. Further, the assembly arm 264 may be adjusted about the second pivot point 268. For example, the assembly arm 264 may be lowered, raised, drawn in, pulled out, or maintain a generally level position with respect to the tray assembly 18. The first pivot point 266 and the second pivot point 268 cooperate in order to allow a user to manipulate the keyboard tray 270 for the purposes of comfort, ergonomics, and usability of the keyboard.

The keyboard tray assembly 20 can also include an auxiliary work surface 236. The auxiliary work surface 236 can extend and retract from the keyboard tray assembly 20 and can generally be placed in any position between its retracted and extended position and can extend from either side of the keyboard tray assembly 20. The auxiliary work surface 236 can be used for manipulating a mouse for the computer 216, or other peripheral device, for example.

In some embodiments, the keyboard tray assembly 20 includes a shouldered bolt 243. As illustrated in FIG. 35, the bolt 243 may be attached to a bottom side of the keyboard tray assembly 20. The auxiliary work surface 236 is attached to the shouldered bolt 243, such that, the auxiliary work surface 236 may rotate on the bolt 243 up to 90 degrees with respect to the keyboard tray assembly 20. The keyboard tray assembly 20 may include an auxiliary work surface on a first side and a second side of the keyboard tray assembly 20. In some embodiments, the keyboard tray assembly 20 includes two auxiliary work surfaces; such that, the user of the workstation 10 may utilize the auxiliary work surface 236 on either side of the keyboard tray assembly 20. For example, the user may be left handed or right handed. The user may utilize a mouse attached to the computer 216 on the left side or right side of the keyboard tray assembly 20 based on whether the user is left handed or right handed.

Referring to FIG. 34, a tray controller 240 can be included in the tray assembly 18 and can incorporate a display panel 244 and a touch pad 248. The display 244 shows at least one condition of at least one aspect of the workstation 10. The tray controller 240 may be housed in a tray controller housing 250. The tray controller housing 250 may be arranged on a front side of the lower tray housing 210. In this manner, the tray controller 240 is accessible to the user of the workstation 10 while the user is operating components or peripherals of the workstation 10. The tray controller 240 may include a tray controller cover 251. The tray controller cover 251 is configured to enclose the display 244 within the tray controller housing 250.

The tray controller 240 comprises a printed circuit board (PCB) 257. The PCB 257 receives inputs from the touch pad 248 and controls components of the workstation 10 based on the inputs. In some embodiments, the PCB 257 generates signals indicative of the inputs and communicates the signals to the computer 216. The computer 216 is configured to interpret the signals and control components of the workstation 10 based on the signals.

In some embodiments, a series of light emitting diodes (LEDs) can be used to light in specific combinations to indicate to a user, the current state of the charge level of the batteries. Other LED patterns can be used to indicate specific states of the workstation 10, such as whether the computer system is currently accessible or inaccessible, or other diagnostic information. The tray controller 240 can also include switches 252 to control the adjustable features of the workstation 10 and to power on and off the computer 216. For example, the tray controller 240 may be in communication with the computer 216. The switches 252 may generate a signal indicative of a user input. When the user input indicates that the user desires to power on or off the computer 216, the tray controller 240 communicates the signal to a power source on the computer 216. The computer 216 powers on or off in response to the signal.

The touch pad 248 can be used by a user to type in a security code to gain "access" to the computer 216 residing in the workstation 10. For example, the user may electronically gain access and use the computer 216 and/or gain physical access to the computer 216. Such a security code can correspond to a specific user and permit the ability of a user to use the computer 216, such as having the computer 216 recognize typing from a keyboard. In this form of electronic access, the touch pad 248 can act as a form of security clearance for the individual who desires to use the computer 216 within the workstation 10.

Additionally, the touch pad 248 can be used by a user to gain physical access to the technology compartment 208 of the tray assembly 18. The touch pad 248 may also be used to gain access to the storage module 22, such as its drawers or bins, if so equipped. As an example, when the workstation 10 is left unattended, the user can type in a code at the touch pad 248 to essentially "lock" physical access to the storage module 22 and/or electronic access to the computer 216. Upon returning to the workstation 10, the user could enter a security code to again physically unlock the storage module 22, but also to electronically unlock the computer 216.

In a third exemplary use scenario, the touch pad 248 cannot provide immediate electronic access to the computer system, but rather the touch pad 248 can be configured to provide electronic access to a security protocol of the computer 216 or its software such that the user is prompted to input security codes or passwords at a computer keyboard.

Upon entry of acceptable security codes or passwords, the user can then be granted electronic access to the computer 216 and/or physical access to the storage module 22 or technology compartment 208.

In addition to controlling electronic access to the computer 216 and physical access to workstation 10, the touch pad 248 or other access control included in the tray controller 240 can control the position of the column assembly 14 and govern the height to which the tray assembly 18 vertically traverses as a "memory function." In such a scenario, the touch pad 248 or switches 252 could be connected to a memory such that the preferred position of the column assembly 14 for a particular user could be stored in memory and when a user code was successfully entered, the column assembly 14 could automatically adjust to the stored position.

In another application of the touch pad 248, after a user uses the touch pad 248 to gain physical access to the storage module 22, electronic access, as opposed to physical access, to the computer 216 can be possible upon entry of another code, thus different codes can be required for different types of access.

Finally, the tray controller 240 can also provide a remote power switch by which a user can turn on or turn off the computer 216 housed within the technology compartment 208 as described above.

The tray controller 240 can also support and operate any of a variety of access controls. For example, a bar code scanner can be used, for example, as a security measure for electronic access to the computer 216. Upon scanning a bar code of an approved user, such as from a security card, immediate computer usage can be permitted, or such scanning can permit a user to then enter security codes or passwords via the computer keyboard to gain electronic and physical access to the workstation 10.

Additionally, the storage module 22 can be locked and unlocked when a user scans an identification badge barcode with the bar code scanner. The tray controller 240 can also incorporate an identification card reader, such as a magnetic stripe card reader, a radio frequency identification card reader ("RFID"), or an optical card reader. In lieu of such a card reader, a flat screen, touch-sensitive security panel, or a biometric security panel such as a fingerprint reader, retinal scanner, or voice recognition access system can be employed by the tray controller 240.

The tray assembly 18 may also include a printer 258. The printer 258 may be attached on a side of the lower tray housing 210 as illustrated in FIGS. 28, 30 and 33. The printer 258 is connected to the computer 216. In some embodiments, the tray controller 240 may communicate with the printer 258 via the computer 216. The user of the workstation 10 may use the touch pad 248 to instruct the printer 258 to print. In some embodiments, it is contemplated that the printer 258 may be utilized to print, for example, records, notes, prescriptions, labels, badges, barcode tags, or the like. The printer 258 may utilize any suitable printing medium, including preformed labels, paper rolls, plain paper, or the like.

The workstation 10 can also incorporate a sanitizing device 260 for disinfecting the workstation 10 and/or its components or peripherals. For example, the sanitation device 260 may include an ultra-violet germicidal lamp emitting UV-C light incorporated into the tray assembly 18 such that it can emit a germ-killing ultra-violet light directed at the keyboard tray assembly 20 and the keyboard when in the stored position to sanitize those components. For example, the keyboard tray assembly 20 may include a position sensor. The position sensor is configured to sense whether the keyboard tray assembly 20 is in a stowed position.

When the position sensor senses the keyboard tray assembly 20 is in the stowed position, the position sensor communicates a signal to the computer 216. The computer 216 initiates the UV-C light in response to receiving the signal from the position sensor. As another example, the sanitation device 260 can include a UV-C light wand. The wand can be included with the workstation 10 as a peripheral device attached to an external surface of the tray assembly 18. The wand can enable a user to "sweep" the workstation 10 and its components, such as the work surface 204, monitor 114, keyboard, mouse, and other peripheral components with the germ-killing ultra-violet light to sanitize the workstation 10.

While the workstation 10 is applicable in a variety of industrial settings, the advantages are easily set forth when the workstation 10 is viewed in a medical environment. For instance, a nurse or other medical professional of a hospital staff can require access to patient information on a real-time basis at the point of application of medical care, such as with a patient while a medical professional makes rounds. When at a point of application, accessing patient information or updating patient data can be entered real-time, into a centralized computer system or stored to the on-board computer, from the workstation 10.

An example of accessing patient information can consist of a professional scanning a barcode on a patient armband with the bar code scanner to view the latest information or entire medical history pertaining to a patient. Then, the professional can update that information by immediately typing information into the computer 216. Another way to update the patient history is to scan a barcode on a medication container, which can then electronically update the patient's history with the medication dispensed and its dosage. Still yet, before dispensing a medication to a patient, the computer 216 can provide an alert to the user in the event that a medication scanned prior to dispensing to the patient, can interact with a medication that the patient is currently taking, or the like.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A mobile computer workstation comprising:

a base assembly including a plurality of wheels;

an adjustable column assembly mounted to the base assembly and adapted to support a computer monitor at first and second vertical positions relative to the base assembly; and a tray assembly mounted to the adjustable column assembly above the base assembly and adapted to support a computer, the tray assembly comprising:

a horizontal work surface comprising an upper tray cover;

a lower tray housing arranged below the upper tray cover, the lower tray housing defining a compartment that receives the computer, the compartment comprising:

at least one expansion wall:

including a front wall portion, a top wall portion, a bottom wall portion, and a side wall portion, excluding a back wall, and selectively adjustable to protrude from the lower housing tray and increase a volume of the lower tray housing to accommodate the computer; and a computer support shelf that secures the computer within the compartment.

2. The mobile computer workstation of claim 1 further comprising a support bracket attachable to the computer support shelf and to an interior surface of the lower tray housing.

3. The mobile computer workstation of claim 2 wherein the support bracket supports the computer support shelf above a bottom of the lower tray housing, such that, the support bracket defines an open space beneath the computer support shelf.

4. The mobile computer workstation of claim 3 further comprising a first plurality of vents arranged on a side of the lower tray housing opposing a second plurality of vents arranged on the expansion wall, wherein the first plurality of vents allow air to flow through the open space to the second plurality of vents.

5. The mobile computer workstation of claim 1 further comprising a tray controller that includes a touch pad and a display.

6. The mobile computer workstation of claim 5 wherein the tray controller receives an input from a user of the workstation via the touch pad and selectively controls at least one component of the workstation in response to the input.

7. The mobile computer workstation of claim 5 wherein the tray controller displays via the display at least one condition of the workstation.

8. The mobile computer workstation of claim 7 wherein the at least one condition includes a current state of charge of a battery integrated within the workstation.

9. The mobile computer workstation of claim 8 wherein the display comprises a plurality of light emitting diodes (LEDs) configured to communicate the state of charge of the battery to the user.

10. The mobile computer workstation of claim 2 further comprising a first vent arranged on a side of the lower tray housing opposing a second vent arranged on the expansion wall operable to allow air from outside of the lower tray housing into the open space.

11. A mobile computer workstation comprising:

a base assembly including a plurality of wheels;

an adjustable column assembly mounted to the base assembly and adapted to support a computer monitor at first and second vertical positions relative to the base assembly; and a tray assembly mounted to the adjustable column assembly above the base assembly and adapted to support a computer, the tray assembly comprising:

a horizontal work surface comprising an upper tray cover;

a lower tray housing arranged below the upper tray cover, the lower tray housing defining a compartment that receives the computer, the compartment comprising:

at least one expansion wall selectively adjustable to increase a volume of the lower tray housing to accommodate the computer; and a computer support shelf that secures the computer within the compartment, wherein the expansion wall is adjusted to a first position based on a width of the computer.

12. The mobile computer workstation of claim 11 wherein the expansion wall aligns with an exterior wall of the lower tray housing when the expansion wall is in the first position.

13. The mobile computer workstation of claim 11 wherein the expansion wall is adjusted to a second position based on the width of the computer.

14. The mobile computer workstation of claim 13 wherein the expansion wall is protrudes out of the lower tray housing when the expansion wall is in the second position.

15. A mobile computer workstation comprising:

a base assembly including a plurality of wheels;

an adjustable column assembly mounted to the base assembly and adapted to support a computer monitor at first and second vertical positions relative to the base assembly; and a tray assembly mounted to the adjustable column assembly above the base assembly and adapted to support a computer, the tray assembly comprising:

a horizontal work surface comprising an upper tray cover;

a lower tray housing arranged below the upper tray cover, the lower tray housing defining a compartment that receives the computer, the compartment comprising:

at least one expansion wall selectively adjustable to increase a volume of the lower tray housing to accommodate the computer;

a computer support shelf that secures the computer within the compartment; and a printer attached to an exterior wall of the lower tray housing and connected to the computer.

16. The mobile computer workstation of claim 15 wherein the computer, in response to a user input, communicates printing instructions to the printer.

17. The mobile computer workstation of claim 16 wherein the printer prints in response to the printing instructions.

18. The mobile computer workstation of claim 16 wherein the user input is received by the computer via a tray controller configured to receive at least one user input at a touch pad.

19. A mobile computer workstation comprising:

a base assembly including a plurality of wheels; and an adjustable column assembly mounted to the base assembly and adapted to support a computer monitor at first and second vertical positions relative to the base assembly; and a tray assembly mounted to the adjustable column assembly above the base assembly and adapted to support a computer, the tray assembly comprising:

a horizontal work surface comprising an upper tray cover;

a lower tray housing arranged below the upper tray cover, the lower tray housing defining a compartment that receives the computer, the compartment comprising:

at least one expansion wall:

including a front wall portion, a top wall portion, a bottom wall portion, and a side wall portion, excluding a back wall, and selectively adjustable to protrude from the lower housing tray and adapt a dimension of the lower tray housing to accommodate the computer; and a computer support shelf that secures the computer within the compartment, the computer support shelf being selectively adjustable with the secured computer to allow access to a plurality of components within the compartment.

20. A mobile computer workstation comprising:

a base assembly including a plurality of wheels; and an adjustable column assembly mounted to the base assembly and adapted to support a computer monitor at first and second vertical positions relative to the base assembly; and a tray assembly mounted to the adjustable column assembly above the base assembly and adapted to support a computer, the tray assembly comprising:

a horizontal work surface comprising an upper tray cover;

a lower tray housing arranged below the upper tray cover, the lower tray housing defining a compartment that receives the computer, the compartment comprising:

at least one expansion wall selectively adjustable to change a size of the lower tray housing to accommodate the computer; and a support that secures the computer within the compartment.

21. A mobile computer workstation comprising:

a base assembly including a plurality of wheels;

an adjustable column assembly mounted to the base assembly and adapted to support a computer monitor at first and second vertical positions relative to the base assembly; and a tray assembly mounted to the adjustable column assembly above the base assembly and adapted to support a computer, the tray assembly comprising:

a horizontal work surface comprising an upper tray cover;

a lower tray housing arranged below the upper tray cover, the lower tray housing defining a compartment that receives the computer, the compartment comprising:

at least one expansion wall selectively adjustable to increase a volume of the lower tray housing to accommodate the computer; and a computer support shelf that secures the computer within the compartment;

wherein a support bracket supports the computer above a bottom of the lower tray housing such that the support bracket defines an open space beneath the computer.

22. The mobile computer workstation of claim 19, wherein the adjustable column assembly comprises first and second columns telescopically engaging each other.

23. The mobile computer workstation of claim 22, wherein the first column includes first and second roller bearings and first and second linear bearing members, the first roller bearing and the first linear bearing member extending laterally outward from a first lateral side of the first column, the second roller bearing and the second linear bearing member extending laterally outward from a second lateral side of the first column.

24. The mobile computer workstation of claim 23, wherein the second column includes first and second lateral channels, the first and second lateral channels movably receiving the first and second roller bearings, respectively, the second column including third and fourth roller bearings extending into the second channel and movably engaging respective surfaces of the first column, the first and second linear bearing members slidably engaging the second column.

25. The mobile computer workstation of claim 24, wherein the first and second linear bearing members are spaced apart from the third and fourth roller bearings by a first distance in the first vertical position and by a second distance in the second vertical position.

26. The mobile computer workstation of claim 25, wherein the first and second linear bearing members define hard stops and abut the third and fourth roller bearings when the second column is in a third vertical position relative to the base assembly, the second vertical position is between the first and third vertical positions.

27. The mobile computer workstation of claim 26, further comprising a filler member engaging an end of the second column and including an opening through which the first column extends into the second channel, the opening is sized to prevent passage of the first and second linear bearing members therethrough.

28. The mobile computer workstation of claim 27, wherein the third and fourth roller bearings are mounted to the filler member.

29. The mobile computer workstation of claim 22, wherein the base assembly further comprises a cavity substantially enclosing an electrical power supply and including an air-inlet opening and an air-outlet opening; and wherein the first and second columns define first and second channels, respectively;

wherein the air-outlet opening is in air-flow communication with the first and second channels; and wherein the first and second channels cooperate to define a chimney to vent heat generated by the electrical power supply.

30. The mobile computer workstation of claim 29, wherein the electrical power supply is operable in a fan-on mode and a fan-off mode and is operable to power at least one electric device in the fan-on mode and in the fan-off mode.

31. The mobile computer workstation of claim 22, wherein the monitor is attached to the second column and movable therewith between the first and second vertical positions.

32. The mobile computer workstation of claim 31, further comprising a monitor mounting bracket assembly including a folding mechanism and first and second brackets, the first and second brackets configured to support first and second monitors, respectively, the folding mechanism causing movement of one of the first and second brackets in response to movement of the other of the first and second brackets.

* * * * *